US006672701B1

(12) United States Patent
Nunokawa

(10) Patent No.: US 6,672,701 B1
(45) Date of Patent: Jan. 6, 2004

(54) DETERMINING ADJUSTMENT VALUE FOR RECORDING POSITION DEVIATION AT PRINTING USING A PLURALITY OF KINDS OF INSPECTING PATTERNS

(75) Inventor: Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/088,799

(22) PCT Filed: Jul. 26, 2001

(86) PCT No.: PCT/JP01/06474

§ 371 (c)(1),
(2), (4) Date: Mar. 22, 2002

(87) PCT Pub. No.: WO02/07983

PCT Pub. Date: Jan. 31, 2002

(30) Foreign Application Priority Data

Jul. 26, 2000 (JP) ..... 2000-224896

(51) Int. Cl.[7] ..... B41J 29/393; B41J 29/38; B41J 2/145; B41J 2/21

(52) U.S. Cl. ..... 347/19; 347/14; 347/41; 347/43

(58) Field of Search ..... 347/19, 14, 23, 347/10, 12, 15, 16, 17, 8, 9, 13, 41, 43, 24, 42

(56) References Cited

U.S. PATENT DOCUMENTS 5,598,272 A * 1/1997 Fisch et al. ..... 358/298
6,164,745 A 12/2000 Nagoshi et al. ..... 347/15
6,164,749 A * 12/2000 Williams ..... 347/19

FOREIGN PATENT DOCUMENTS

| | | |
|---|---|---|
| EP | 0 631 257 A2 | 12/1994 |
| EP | 0 895 869 A2 | 7/1998 |
| EP | 0 982 139 A1 | 3/2000 |
| JP | 5-69625 | 3/1993 |
| JP | 7-81190 | 3/1995 |
| JP | 2001-38930 | 2/2001 |

* cited by examiner

*Primary Examiner*—Raquel Yvette Gordon
*Assistant Examiner*—Charles W. Stewart, Jr.
(74) *Attorney, Agent, or Firm*—Sughrue Mion, PLLC

(57) ABSTRACT

Determination of an adjustment value for adjusting the shifting of recording positions is made easier. The adjustment value is one for adjusting the shifting of recording positions in the direction of main scanning when ink drops are ejected and dots formed on a print medium. Patches T21–T25 and patches T31–T35 are printed in order to determine the extent (adjustment value) to which dot formation positions are shifted on a reverse pass during bidirectional printing. Each patch is formed based on the same print data D1 related to yellow (Y), light cyan (LC), and light magenta (LM) dots. Each dot is formed on the forward and reverse passes of main scanning when the patches T21–T25 are formed. The patches are printed by varying the dot recording positions on a reverse pass in small increments. The patches T31–T35 are formed solely on the forward pass of a main scan. The extent (adjustment value) to which the timing for ejecting ink drops with minimal dot formation misalignments is shifted can be determined by selecting from the patches T21–T25 the patch whose print results are the closest to the adjacent patches T31–T35.

27 Claims, 18 Drawing Sheets

SUB-SCANNING FEEDING AND NOZZLE POSITIONS

| PASS | | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|---|
| SCANNING DIRECTION | | → | ← | → | ← | → | ← | → | ← | → | ← | → | ← | → | ← | → | ← | → |
| RECORDING PATCH | 1 | ○ | ○ | | | ○ | ○ | | | ○ | ○ | | | ○ | ○ | | | ○ |
| | 2 | ○ | | ○ | | ○ | | ○ | | ○ | | ○ | | ○ | | ○ | | ○ |

PASSES AND NOZZLES FOR RECORDING FIRST VERIFICATION PATTERN

| PASS | | 1 | 2 | 5 | 6 | 9 | 10 | 13 | 14 | 17 |
|---|---|---|---|---|---|---|---|---|---|---|
| SCANNING DIRECTION | | → | ← | → | ← | → | ← | → | ← | → |
| RECORDING PATCH | 1 | ○ | ○ | ○ | ○ | ○ | ○ | ○ | ○ | ○ |

PASSES AND NOZZLES FOR RECORDING SECOND VERIFICATION PATTERN

| PASS | | 1 | 3 | 5 | 7 | 9 | 11 | 13 | 15 | 17 |
|---|---|---|---|---|---|---|---|---|---|---|
| SCANNING DIRECTION | | → | → | → | → | → | → | → | → | → |
| RECORDING PATCH | 2 | ○ | ○ | ○ | ○ | ○ | ○ | ○ | ○ | ○ |

| PASS | | 1 | 2 | 3 | 4 | 5 | 6 | 7 | 8 | 9 |
|---|---|---|---|---|---|---|---|---|---|---|
| SCANNING DIRECTION | | → | ← | → | ← | → | ← | → | ← | → |
| RECORDING PATCH | 1 | ○ | ○ | ○ | ○ | ○ | ○ | ○ | ○ | ○ |
| | 2 | ○ | ○ | ○ | ○ | ○ | ○ | ○ | ○ | ○ |

Fig. 18

| PATCH FORMATION / ADJUSTMENT VALUE | MODIFICATION 1: EXTENDED IN THE DIRECTION OF SUB SCANNING | MODIFICATION 2: EXTENDED IN THE DIRECTION OF MAIN SCANNING | MODIFICATION 3: IMAGE DATA SELECTED | MODIFICATION 4: DATA OBTAINED FROM PRINTING IMAGE |
|---|---|---|---|---|
| DOT MISALIGNMENT ADJUSTMENT FOR BIDIRECTIONAL PRINTING | ○ | ○ | ○ | ○ |
| DOT MISALIGNMENT ADJUSTMENT BETWEEN NOZZLES | ○ | ○ | ○ | ○ |

DETERMINING ADJUSTMENT VALUE FOR RECORDING POSITION DEVIATION AT PRINTING USING A PLURALITY OF KINDS OF INSPECTING PATTERNS

TECHNICAL FIELD

The present invention relates to a technique for printing images by forming dots on a print medium during main scanning, and more particularly to a technique for adjusting recording position misalignments in the direction of main scanning and reducing the graininess of images printed in color.

BACKGROUND TECHNOLOGY

Color printers of the type in which inks of several colors are ejected from a head are currently used on a wide scale as computer output devices. Such color printers include those in which images are printed by ejecting ink drops from nozzles to form dots on a print medium during main scanning.

Printing systems can be divided into unidirectional printing systems in which images are printed only during the forward or reverse pass of a main scan, and bidirectional printing systems in which images are printed during both forward and reverse passes. Many of the contemporary color-ink jet printers utilize both unidirectional and bidirectional printing.

In a printing operation in which ink drops are ejected from nozzles to form dots on a print medium, the recording positions of the dots sometimes become misaligned due to the backlash of the drive mechanism for main scanning, the warping of the platen that supports the print medium from below, and the like. The method disclosed in JP 5-69625A, which has previously been filed by the present applicant, is known as an example of a technique aimed at preventing such misalignments. According to this conventional technique, adjustment values designed to cancel out dot formation misalignments in the direction of main scanning are recorded in advance, and recording positions are corrected on forward and reverse passes on the basis of these adjustment values.

Correcting dot formation misalignments in this manner can be used not only to correct misalignments between forward and reverse passes during bidirectional printing, but also to correct misalignments among dots of different color nozzles during unidirectional printing.

Conventional techniques for correcting dot formation misalignments were primarily aimed at prevent straight lines from becoming jaggy in the direction perpendicular to the direction of main scanning. However, though making straight lines less jaggy, printed images sometimes become grainy in color printing due to minute misalignments affecting dots of various colors. It has so far been difficult to reduce such graininess in printed images with the aid of conventional correction methods.

An object of the present invention, which was devised in order to overcome the above-described shortcomings of the prior art, is to provide a technique for adjusting recording position misalignments in the direction of main scanning and reducing the graininess of images printed in color.

DISCLOSURE OF THE INVENTION

Aimed at partially addressing the above-described problems, the present invention entails setting an adjustment value designed to reduce dot formation misalignments in a direction of main scanning during a process in which a printing device provided with a plurality of monochromatic nozzle groups for ejecting ink drops having mutually different colors is used to print images by depositing ink drops on a print medium and to form dots while main scanning is performed to move the plurality of monochromatic nozzle groups and/or the print medium. For the printing, a plurality of first color patches are formed on a print medium with dots composed of two or more types of ink for a plurality of auxiliary adjustment values, respectively. The plurality of first color patches are designed to reproduce mutually identical colors. A second color patch is formed on a print medium using dots composed of two or more types of ink in a different color and/or different method from that of the plurality of first color patches. The adjustment value is selected from the plurality of auxiliary adjustment values on the basis of the plurality of first color patches and the second color patch. Adopting this approach makes it possible to set an adjustment value after comparing the graininess of color patches that differ in color and/or printing scheme. As a result, it is possible to adjust recording position misalignments in the direction of main scanning and to reduce the graininess of images printed in color.

The second color patch is preferably formed on the print medium by a printing scheme different from that adopted for the plurality of first color patches, when the second color patch is formed. The second color patch reproduces the same color as that adopted for the plurality of first color patches. Adopting this approach makes it easier to select an adjustment value capable of yielding higher quality during printing by various printing schemes because a color patch with the same reproduction color is printed using a different printing scheme.

The plurality of first color patches are preferably formed by bidirectional printing, when the first color patch is formed. The second color patch is preferably formed by unidirectional printing, when the second color patch is formed. A dot formation misalignment brought about by bidirectional printing does not appear during unidirectional printing. With this arrangement, therefore, a first color patch in which bidirectional printing induces only a minimal dot formation misalignment can be easily selected by comparing a first color patch obtained by bidirectional printing and a second color patch obtained by unidirectional printing.

It is preferable that gray is selected as a color of the plurality of first color patches and the second color patch. Adopting this arrangement allows adjustment values to be set by conducting a comprehensive assessment of the effect of dot misalignments affecting on the color inks used for color printing.

When the second color patch is formed, a plurality of second color patches for reproducing mutually identical colors are preferably formed at positions aligned in the direction of main scanning in relation to the plurality of first color patches. With this arrangement, the area occupied by first and second misalignment verification patterns on a print medium can be provided with smaller dimensions in the direction perpendicular to the direction of main scanning.

When the second color patch is formed, a plurality of second color patches may be formed on the print medium using the plurality of auxiliary adjustment values by the same printing scheme as the one used to print the plurality of first color patches. The plurality of second color patches may be designed to reproduce mutually identical colors and may be colored differently than the plurality of first color patches. Adopting this arrangement allows adjustment values to be set with consideration for the print quality of different color images. In this arrangement, the plurality of second color patches may be formed at positions aligned in the direction of main scanning in relation to the plurality of first color patches.

It is preferable that each of the first color patches are formed over at least one fourth of a printable area on the print medium in a direction perpendicular to the direction of main scanning. It is also preferable that the second color patch is formed over at least one fourth of the printable area on the print medium in the direction perpendicular to the direction of main scanning. Adopting this arrangement allows adjustment values to be set with consideration for dot formation misalignments that vary in the direction perpendicular to the direction of main scanning on a print medium.

It is preferable that the first color patches are formed over at least half of a printable area on the print medium in the direction of main scanning. It is also preferable that the second color patch is formed over at least half of the printable area on the print medium in the direction of main scanning. Adopting this arrangement allows adjustment values to be set with consideration for dot formation misalignments that vary in the direction of main scanning on a print medium.

The present invention can be implemented as the following embodiments.

(1) Adjustment value determination methods, printing methods, and printing control methods.

(2) Printing devices and print control devices.

(3) Computer programs for operating such devices or performing such methods.

(4) Storage media containing computer programs for operating such devices or performing such methods.

(5) Data signals having the form of carrier waves and containing computer programs for operating such devices or performing such methods.

BRIEF DESCRIPTION OF THE DRAWINGS

FIG. 18 is a table that lists combinations of modifications and types of misalignments to be adjusted with adjustment values.

DESCRIPTION OF THE PREFERRED EMBODIMENTS

Embodiments of the present invention will now be described through working examples in the following sequence.

A. Overview of Embodiments
B. Device Structure
C. Occurrence of Recording Misalignment Among Nozzle Rows
D. First Working Example
E. Second Working Example
F. Modifications
G. Other Modifications

A. Overview of Embodiments

Figure 1:
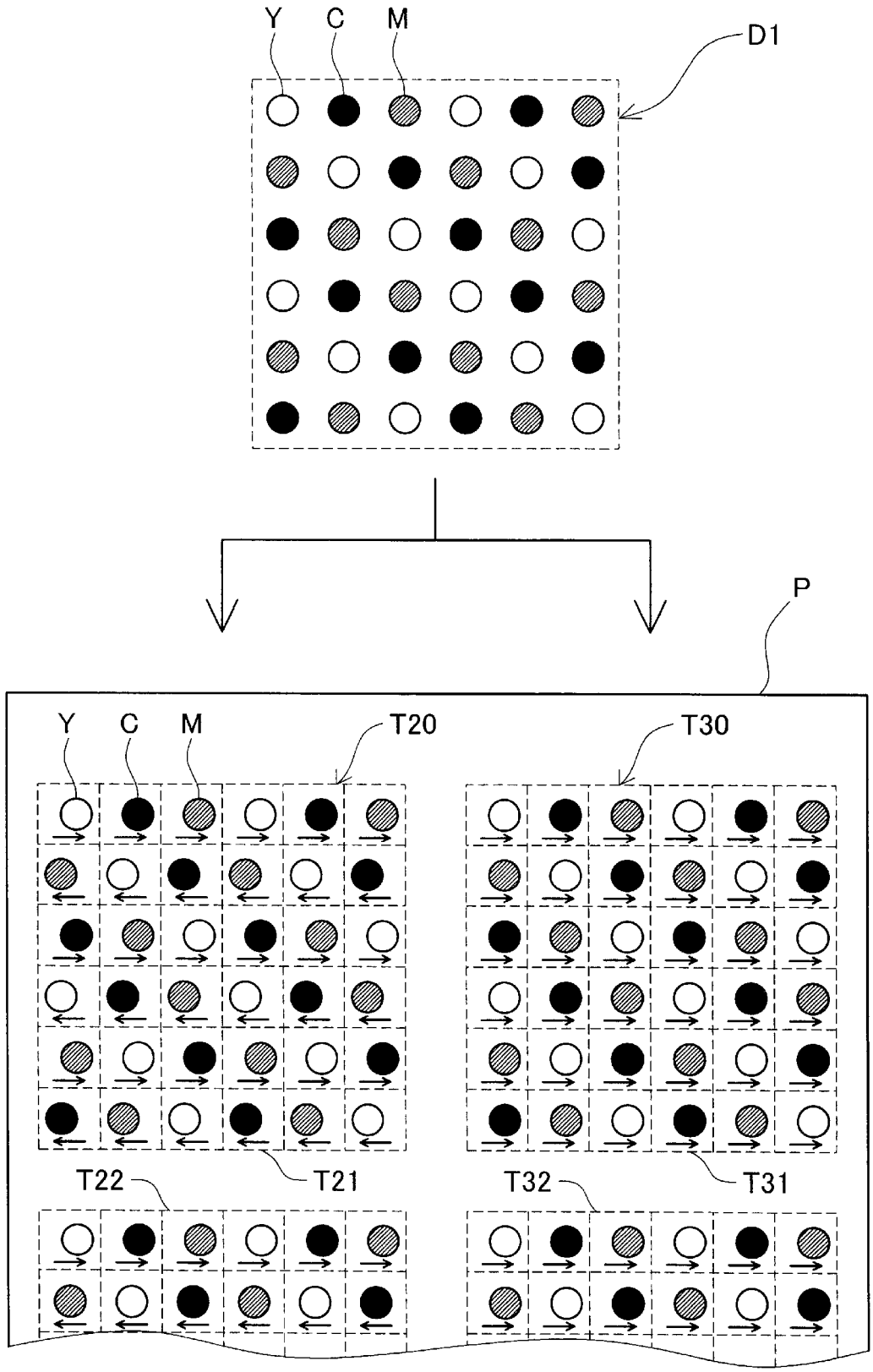
FIG. 1 is a diagram depicting an embodiment concept.

FIG. 1 is a diagram depicting an embodiment concept. In a printing device for bidirectional printing, the dot formation misalignments occurring during forward and reverse passes are removed by adjusting the timing with which ink drops are ejected during the reverse passes of main scans. A first misalignment verification pattern T20 and a second misalignment verification pattern T30 are printed on the printing paper P as misalignment verification patterns for determining these misalignment values (adjustment values) for the adjusting. The first misalignment verification pattern T20 comprises longitudinally aligned first gray patches T21–T25 (T23–T25 are not shown in FIG. 1). The second misalignment verification pattern T30 comprises second gray patches T31–T35 (T33–T35 are not shown in FIG. 1), which are formed on the right side of the first gray patches T21–T25, respectively, in the direction of main scanning. These two types of patches (quadrilateral printed images) are formed based on identical image data D1. The image data D1 are print data for the yellow (Y), light-cyan (LC), and light-magenta (LM) dots shown in FIG. 1, and represent data related to images with an overall gray appearance.

Yellow (Y), light-cyan (LC), and light-magenta (LM) dots are formed during the forward and reverse passes of main scans to form the first gray patches T21–T25. The dots are formed solely during the forward passes of main scans when the second gray patches T31–T35 are formed. The arrow signs underneath the Y, C, and M circles depicting the dots in FIG. 1 show the orientation of main scanning for recording the dots. The ink drops move through the air in different directions on the forward and reverse passes of main scanning because the print head varies its orientation. For this reason, the dots recorded on a forward pass and the dots recorded on a reverse pass have different dot formation positions for the first gray patches T21 and T22 in FIG. 1. By contrast, the second gray patches T31 and T32 are obtained by recording dots during forward passes alone, so the misalignment of dots in the gray patches T31–T35 is more uniform than in the first gray patches T21 and T22.

The gray patches T21–T25 of the first misalignment verification pattern T20 are printed by slightly varying the timing with which ink drops are ejected during reverse passes. Dot formation positions will therefore be misaligned differently in each of the gray patches T21–T25. The misalignment value of a timing that allows ink drops to be ejected with minimal dot formation misalignment can be set by selecting a patch whose print results are the closest to those delivered by the adjacently printed gray patches T31–T35 of the second misalignment verification pattern T30. This misalignment value can serve as an adjustment value for removing dot formation misalignments.

B. Device Structure

Figure 2:
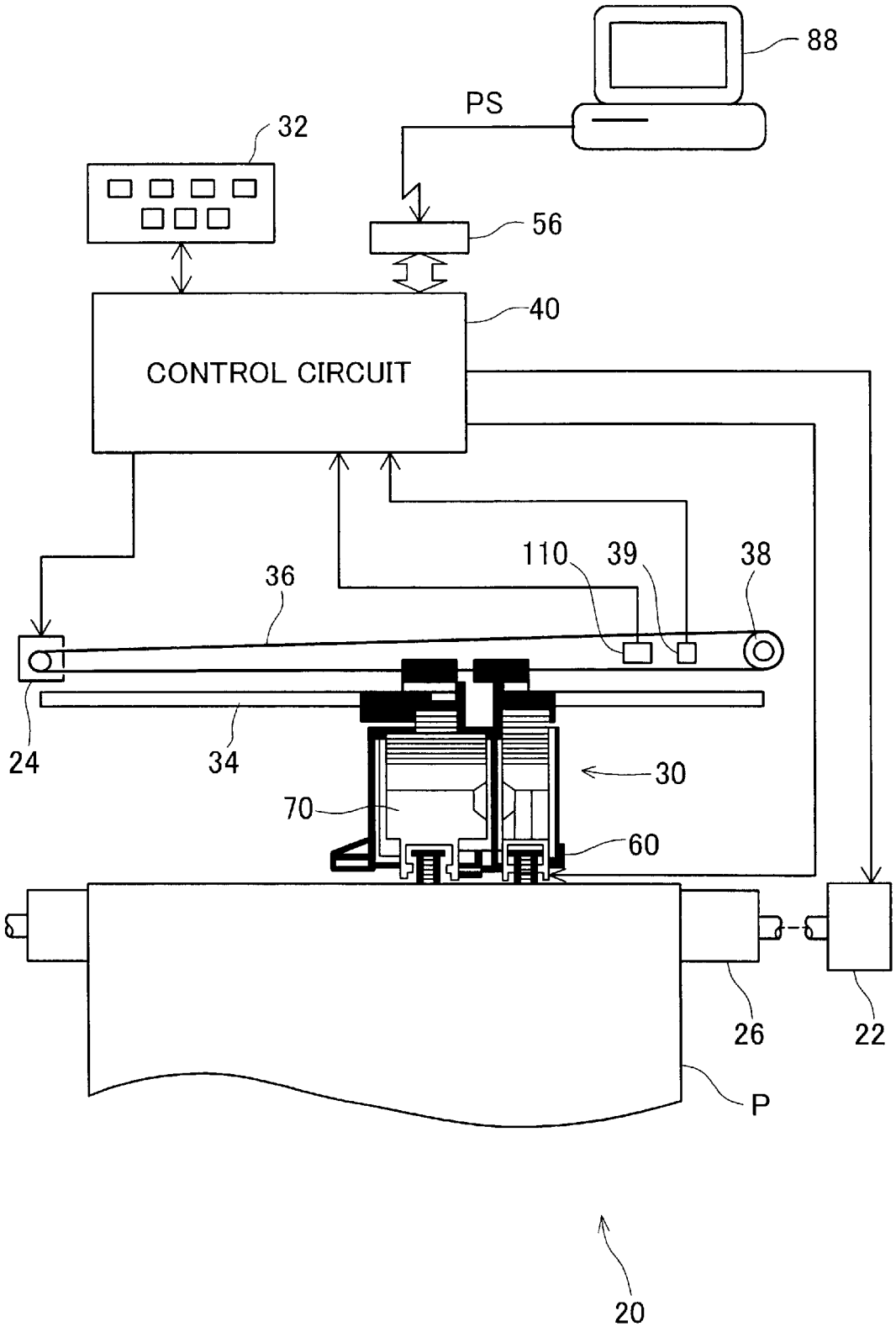
FIG. 2 is a schematic of a printing system equipped with the printer 20 of a first working example.

FIG. 2 is a schematic block diagram of a printing system equipped with an ink-jet printer 20 as a working example of the present invention. The printer 20 comprises a sub-scanning mechanism for transporting printing paper P in the direction of sub-scanning by means of a paper feed motor 22, a main scanning mechanism for reciprocating a carriage 30 in the axial direction (direction of main scanning) of a platen 26 by means of a carriage motor 24, a head drive mechanism for ejecting ink and forming dots by actuating a print head unit 60 mounted on the carriage 30, and a control circuit 40 for controlling exchanging signals among the paper feed motor 22, the carriage motor 24, the print head unit 60, and a control panel 32. The control circuit 40 is connected via a connector 56 to the computer 88.

The sub-scanning mechanism for transporting the printing paper P comprises a gear train (not shown) for transmitting the rotation of the paper feed motor 22 to the platen 26 and a roller (not shown) for transporting the printing paper. The main scanning mechanism for reciprocating the carriage 30 comprises a sliding shaft 34 mounted parallel to the axis of the platen 26 and designed to slidably support the carriage 30, a pulley 38 for extending an endless drive belt 36 from the carriage motor 24, and a position sensor 39 for sensing the original position of the carriage 30.

Figure 3:
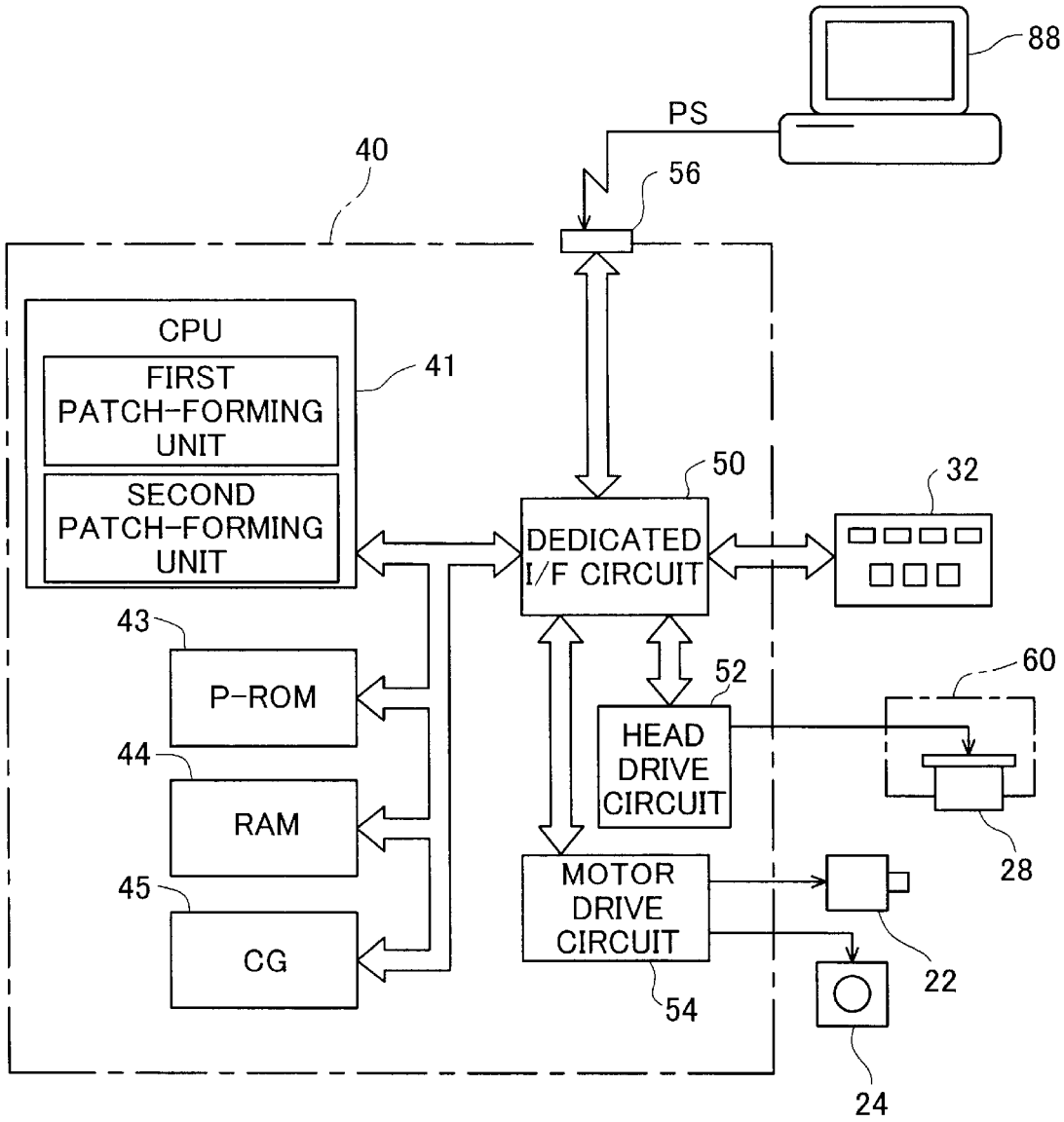
FIG. 3 is a block diagram depicting the structure of a control circuit 40 for the printer 20.

FIG. 3 is a block diagram depicting the structure of a printer 20, chiefly the control circuit 40. The control circuit 40 is designed as an arithmetic Boolean circuit comprising a CPU 41, a programmable ROM (PROM) 43, a RAM 44, and a character generator (CG) 45 containing dot matrices for characters. The control circuit 40 further comprises a dedicated I/F circuit 50 for creating a dedicated interface with external motors and the like, a head drive circuit 52 connected to the dedicated I/F circuit 50 and designed to eject ink by actuating the print head unit 60, and a motor drive circuit 54 for actuating the paper feed motor 22 and carriage motor 24. The dedicated I/F circuit 50 contains a parallel interface circuit and is capable of receiving print signals PS from the computer 88 via the connector 56.

Figure 4:
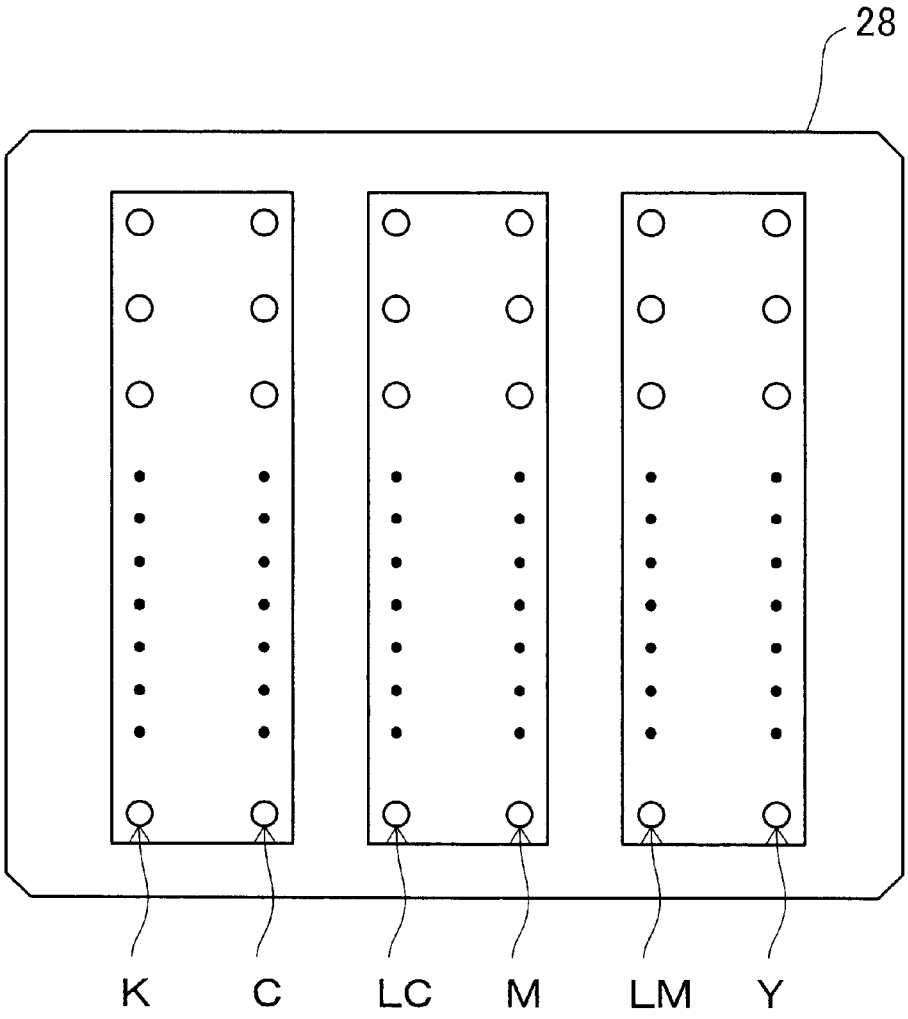
FIG. 4 is a diagram depicting a plurality of nozzle rows provided to a print head 28.

FIG. 4 is a diagram depicting a plurality of nozzle rows provided to a print head 28. The printer 20 is a printing device for printing using inks of the following six colors: black (K), dark cyan (C), light cyan (LC), dark magenta (M), light magenta (LM), and yellow (Y). The printer is provided with a row of nozzles for each ink. Dark cyan and light cyan are cyan inks with substantially the same hues but different densities. The same applies to the dark magenta ink and light magenta ink. These nozzle rows correspond to "the single-color nozzle groups" referred to in the claims.

C. Occurrence of Recording Misalignment Among Nozzle Rows

The recording misalignments occurring during bidirectional printing are adjusted in accordance with the first working example described below. The occurrence of a recording misalignment during bidirectional printing will be described herein before the first working example is described. The term "bidirectional printing" refers to a printing method in which main scans are performed in both directions, and dots are formed on a print medium both on the forward passes and on the reverse passes of main scanning to print images. By contrast, the term "unidirectional printing" is reserved for a printing medium in which dots are formed on a print medium solely during the forward or reverse passes of main scanning to print images.

Figure 5A:
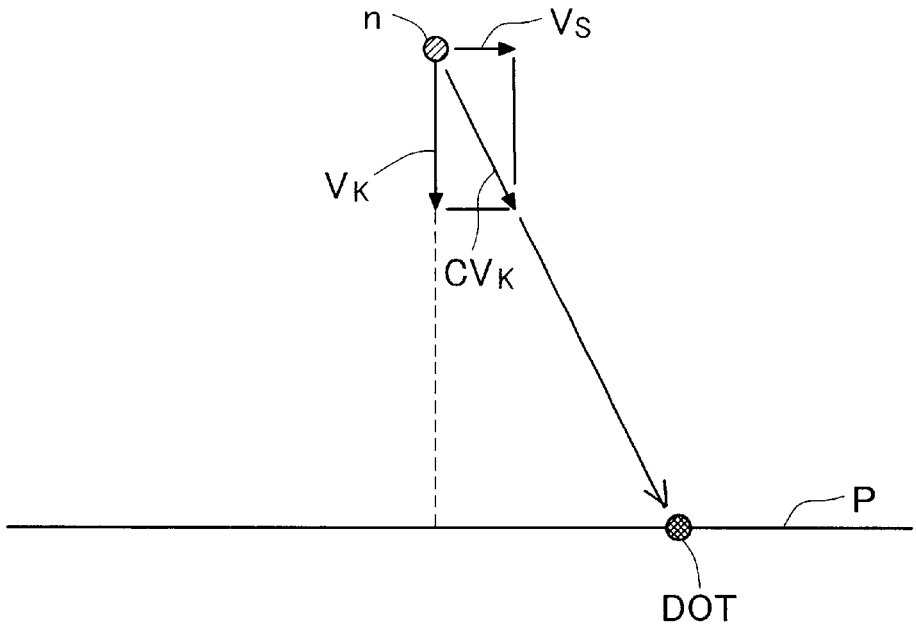
FIG. 5A is a diagram depicting an impact position occupied by a dot on a forward pass during printing.
Figure 5B:
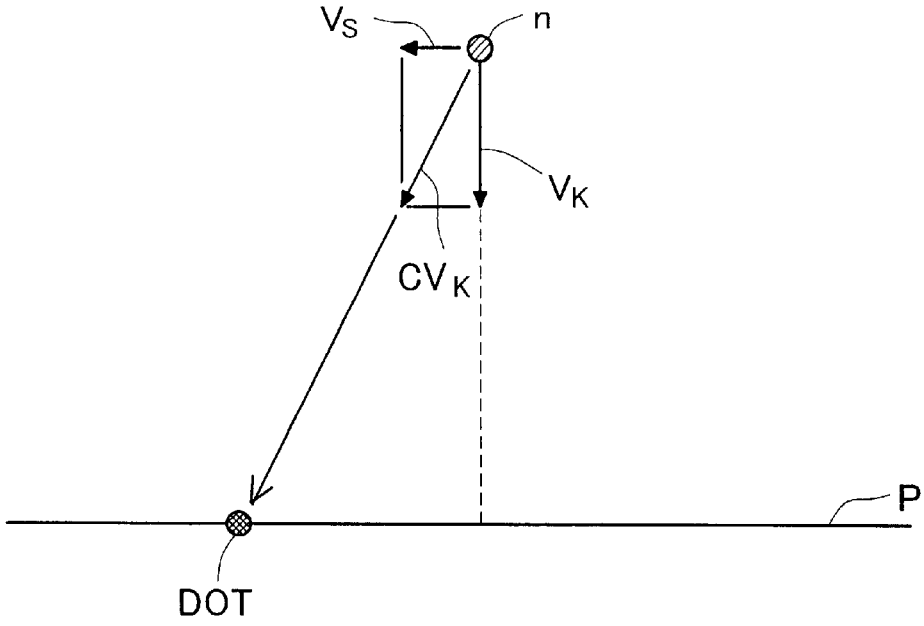
FIG. 5B is a diagram depicting an impact position occupied by a dot on a reverse pass during printing.

FIG. 5 is a diagram depicting a misalignment occurring during bidirectional printing. FIG. 5A is a diagram depicting an impact position occupied by a dot on a forward pass during printing, and FIG. 5B is a diagram depicting an impact position occupied by a dot on a reverse pass during printing. A nozzle n forms dots on the printing paper P by moving horizontally in two directions over the printing paper P and ejecting ink on the forward and reverse passes. It is assumed that the ink is ejected vertically downward at an ejection velocity Vk. The combined velocity vector CVk of each ink is obtained by combining the downward ejection velocity vector and the main scan velocity vector Vs of nozzle n. Consequently, the positions at which ink drops strike the print medium are misaligned when the ink drops are ejected while the printing paper P and the print head 28 (nozzle n) are in the same positional relation on the forward and reverse passes during main scanning. In view of this, the timing with which the ink drops are ejected on the forward and reverse passes during main scanning is adjusted in order to align the positions at which the ink drops strike the print medium.

In FIG. 5, the dot formation misalignments are substantially symmetrical about the position occupied by nozzles during the ejection of ink drops on forward and reverse passes. There are, however, factors that act to prevent the misalignment on the forward and reverse passes from being completely symmetrical, such as the backlash of the drive mechanism for main scanning and the warping of the platen that supports the print medium from below. The timing with which ink drops are ejected on the forward and reverse passes during main scanning should preferably be adjusted in order to absorb the dot formation misalignments caused by these factors.

D. First Working Example

Figure 6:
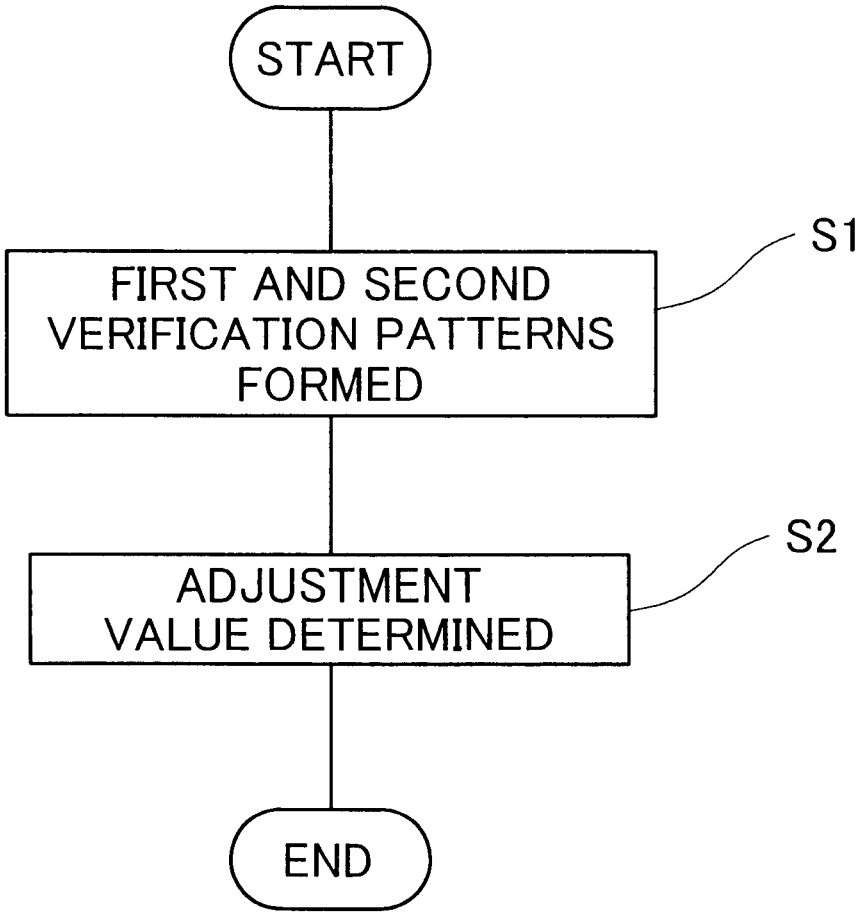
FIG. 6 is a flowchart depicting the entire routine performed in accordance with the first working example of the present invention.

FIG. 6 is a flowchart depicting the entire routine performed in accordance with the first working example of the present invention. In step S1, a first misalignment verification pattern and a second misalignment verification pattern are formed. In subsequent step S2, the operator sets an adjustment value on the basis of the first and second misalignment verification patterns, and enters the information into the printer 20. A detailed description of each step follows.

Figure 7:
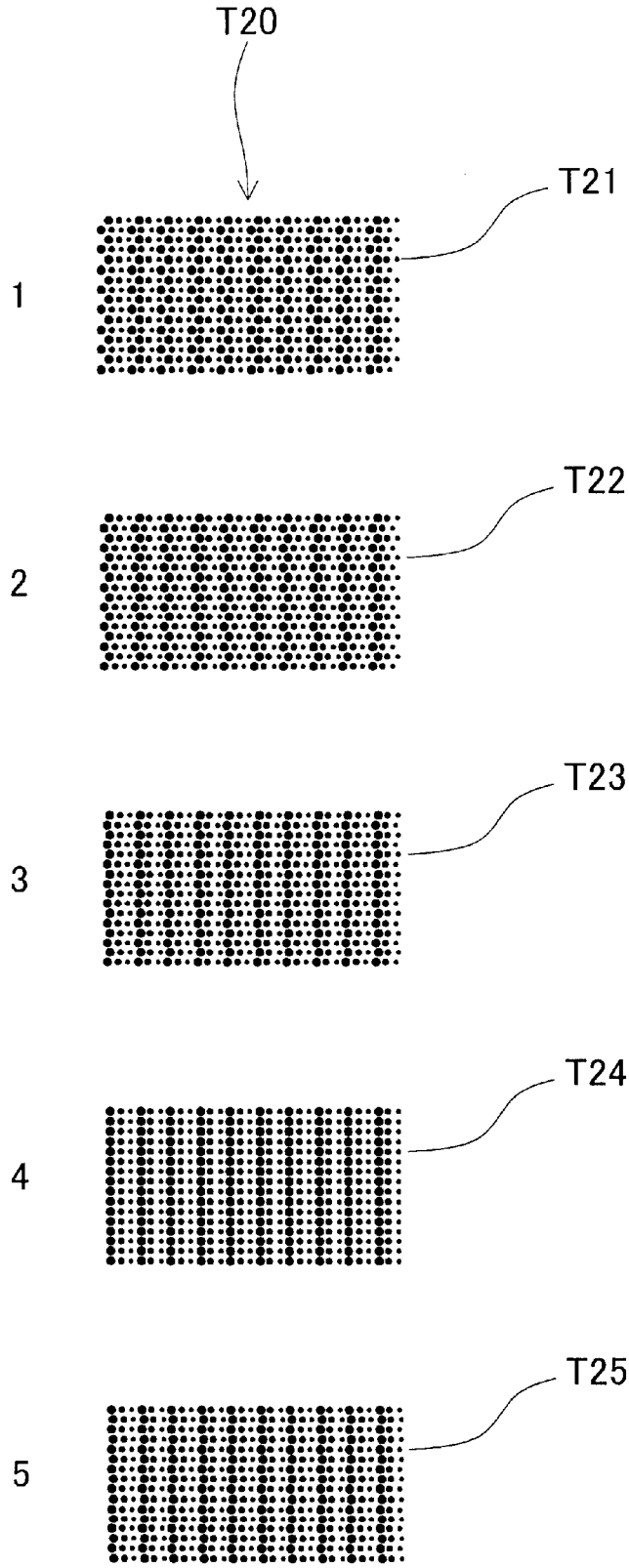
FIG. 7 is a diagram depicting an example of a first misalignment verification pattern T20.

FIG. 7 is a diagram depicting an example of a first misalignment verification pattern T20. In step S1 (see FIG. 6), a first misalignment verification pattern is printed by the printer 20. The first misalignment verification pattern T20 is composed of a plurality of gray patches T21–T25 printed on the forward and reverse passes by light-cyan, light-magenta, and yellow nozzle rows. Each gray patch is designed to reproduce the same color. The gray patches T21–T25 correspond to "the first gray patches" referred to in the claims. Although each of the patches in FIG. 7 is shown as an aggregation of comparatively large dots, in reality the dots can be so small as to be virtually invisible to the eye. The term "gray patch" does not mean that a patch will always appear as having a gray color to the human eye. In other words, other colors might be visible under certain dot misalignment conditions.

The dots of each color constituting each patch are recorded at the same position in the direction of main scanning in each patch on a forward pass. But on reverse passes, the dots of each color constituting each patch are recorded at the position shifted in the direction of main scanning sequentially in 1/2880-inch increments for each patch. The dots of each color constituting each patch are shifted by a common value in each reverse pass. As a result, a plurality of gray patches T21–T25 are printed on the printing paper P such that there is a shift of 1/2880 inch between the relative positions of dots formed on forward passes and dots formed on reverse passes. The extent to which the dots of each gray patch are shifted on the reverse passes to that on the forward pass corresponds to "the auxiliary adjustment value" referred to in the claims. Numerals designating shift adjustment numbers are printed on the left side of gray patches T21–T25, as shown in FIG. 7. The shift adjustment numbers function as correction-related information about the preferred correction state. As used herein, the term "preferred correction state" refers to a state in which the grainy feel of a gray patch is minimized when the recording positions (or recording timings) on forward and/or reverse passes are corrected with appropriate adjustment values. The preferred corrected condition can therefore be actualized by such appropriate adjustment values.

The example in FIG. 7 illustrates five gray patches T21–T25, which are provided with shift adjustment numbers from 1 to 5 and are centered around a gray patch T23 labeled with the numeral "3." In FIG. 7, the gray patch T24 with a shift adjustment number of 4 illustrates a preferred correction state of minimal graininess.

The gray patches T21–T25 are designed to reproduce mutually equal colors and are formed based on identical print data D1. The print data D1 that form the basis for the gray patches T21–T25 are obtained by a process in which color image data for expressing aggregated pixels of uniform density are converted to data for expressing the recording conditions of dots having a plurality of ink colors. The print data D1 are stored on a hard disk (storage unit) in the computer 88. The gray patches T21–T25 are printed in step S1 in accordance with a sub-scanning pattern for actual printing. The corresponding feed method is described below. The gray patches T21–T25 are formed while the CPU 41 controls the units comprising the ink-jet printer 20. In other words, the CPU 41 functions as "the first patch-forming unit" referred to in the claims.

Figure 8:
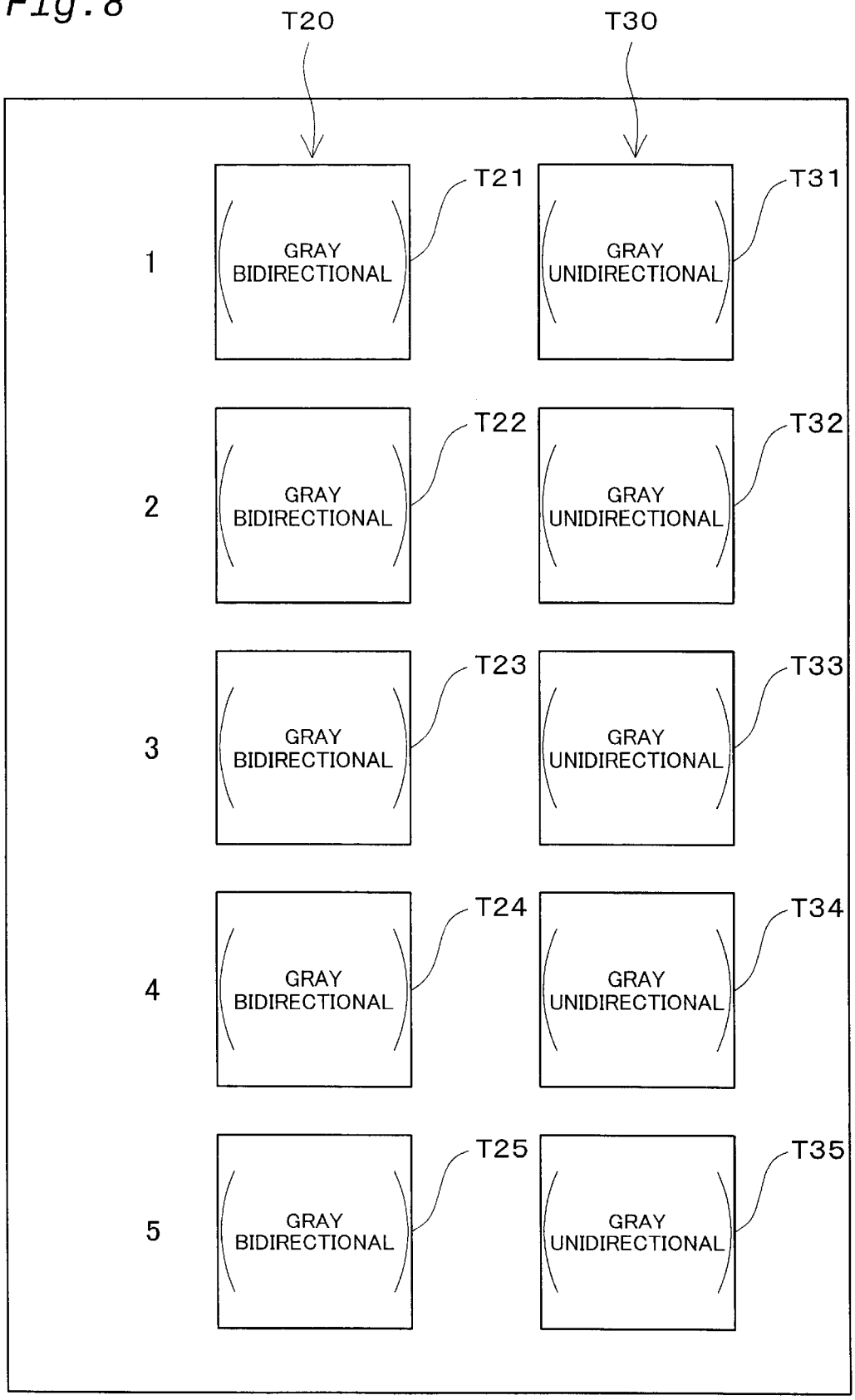
FIG. 8 is a plan view depicting the first misalignment verification pattern T20 and a second misalignment verification pattern T30 on the printing paper P.

FIG. 8 is a plan view depicting the first misalignment verification pattern T20 and second misalignment verification pattern T30 on the printing paper P. Gray patches T31–T35 are formed in a corresponding one-on-one relationship on the right side of the gray patches T21–T25 constituting the first misalignment verification pattern T20. The gray patches T31–T35 are formed from the same ink as that used for the gray patches T21–T25 on the basis of the same print data D1 as that used for the gray patches T21–T25. The gray patches T31–T35 can thus reproduce the same colors as those adopted for the gray patches T21–T25. The only difference is that the gray patches T31–T35 are printed solely on the forward passes of main scanning. In other words, a different printing method is used for the gray patches T31–T35 than for the gray patches T21–T25. The gray patches T31–T35 constitute the second misalignment verification pattern T30. The gray patches T31–T35 correspond to "the second color patches" referred to in the claims. Since the gray patches T31–T35 are printed on forward passes alone, the timings according to which ink drops are ejected to form dots are not shifted relative to each other in the manner encountered with the gray patches T21–T25. The gray patches T31–T35 are also formed while the CPU 41 controls the constituent units of the ink-jet printer 20. In other words, the CPU 41 functions as "the second patch-forming unit" referred to in the claims.

Figure 9:
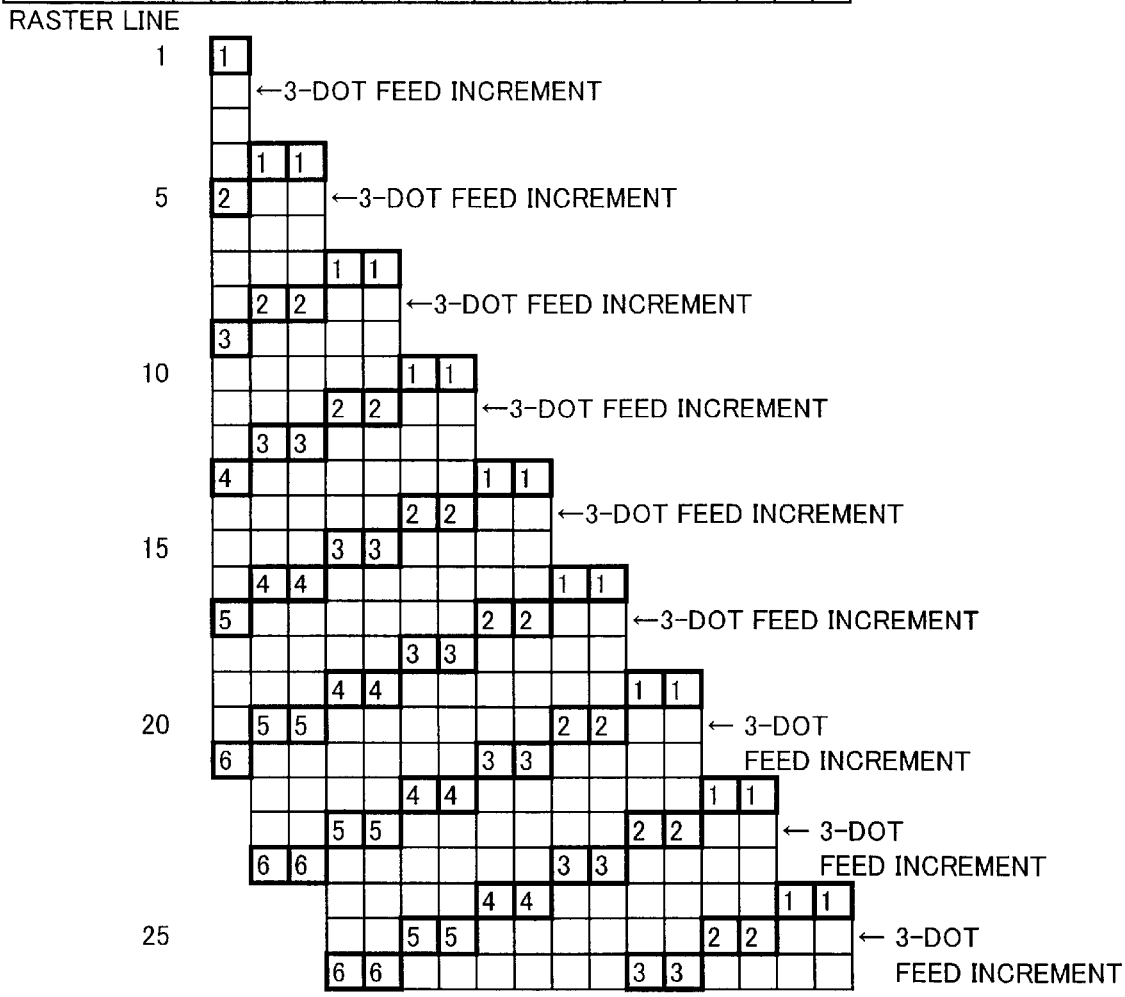
FIG. 9 is a diagram illustrating the manner in which the print head is advanced and dots are recorded during each main scan during the printing of the first misalignment verification pattern T20 and second misalignment verification pattern T30.

FIG. 9 is a diagram illustrating the manner in which the print head is advanced and dots are recorded during each main scan during the printing of the first and second misalignment verification patterns. For the sake of convenience, the description given herein will refer to the use of a print head having six single-row nozzles. The nozzle pitch k between the nozzles is 4. The term "nozzle pitch" is a value equal to the number of raster lines (that is, pixels) constituting the interval between the nozzles on the print head in the direction of sub-scanning. For example, the pitch k is equal to 4 when three-raster lines can be placed between two nozzles. The terms "raster line" refers to pixels arranged in a row in the direction of main scanning. The term "pixel" refers to a square on an imaginary grid drawn on a print medium in order to define the positions at which dots are to be recorded on the print medium.

In the table shown in the top part of FIG. 9, the numbers given in the "pass" row indicate the main scan being performed. The arrows in the "scan direction" row indicate whether a particular main scan proceeds in the direction of a forward or reverse pass. An arrow pointing to the right indicates a main scan on a forward pass, whereas an arrow pointing to the left indicates a reverse pass. In the "recording patch" row, a circle in row 1 refers to the recording of dots on the first misalignment verification pattern T20 during the corresponding main scan, and a circle in row 2 refers to the recording of dots on the second misalignment verification pattern T30 during the corresponding main scan. In the case shown in FIG. 9, three-dot sub-scans are performed during each full main scan so that the first misalignment verification pattern T20 is recorded on the forward and reverse passes of main scanning, and the second misalignment verification pattern T30 is simultaneously recorded on the forward passes of main scanning. Idle recording periods and periods during which the first misalignment verification pattern T20 is recorded appear alternately every other full main scan (every two main scans). In addition, idle recording periods and periods during which the second misalignment verification pattern T30 is recorded appear alternately with every main scan. Neither misalignment verification pattern is recorded during main scans that are multiples of four.

Figure 10:
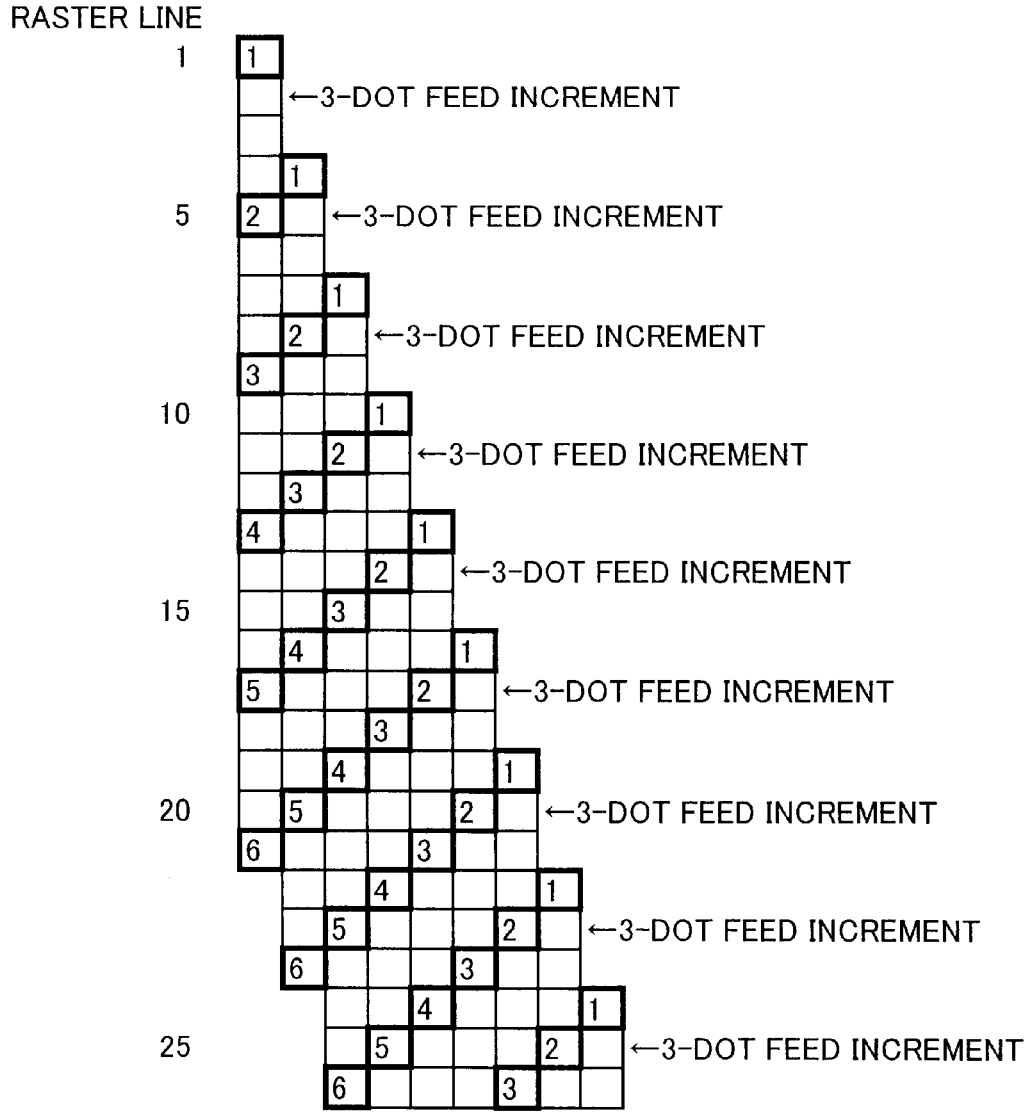
FIG. 10 is a diagram depicting solely the passes during which the first misalignment verification pattern T20 is recorded.

FIG. 10 depicts only those passes shown in FIG. 9 during which the first misalignment verification pattern T20 is recorded. The first misalignment verification pattern T20 is such that dots are recorded on the first, second, fifth, sixth, and other main scans, as shown in FIG. 10. Of these, first, fifth, and any other main scan whose number is greater by one than a multiple of four are forward passes, and second, sixth, and any other main scan whose number is greater by two than a multiple of four are reverse passes. As a result, each of the raster lines in the first misalignment verification pattern T20 contains elements recorded on forward passes by the two corresponding nozzles and elements recorded on reverse passes by the two corresponding nozzles, alternated in the direction of sub-scanning (see FIG. 1).

When actual images are printed after the adjustment values have been determined, feed patterns are performed such that the system is fed in three-dot increments in the direction of sub-scanning during every pass of main scanning. Specifically, the first misalignment verification pattern T20 is printed according to a pattern substantially identical to a repeating pattern of sub-scan feed increments when images are printed after the adjustment values have been determined.

Figure 11:
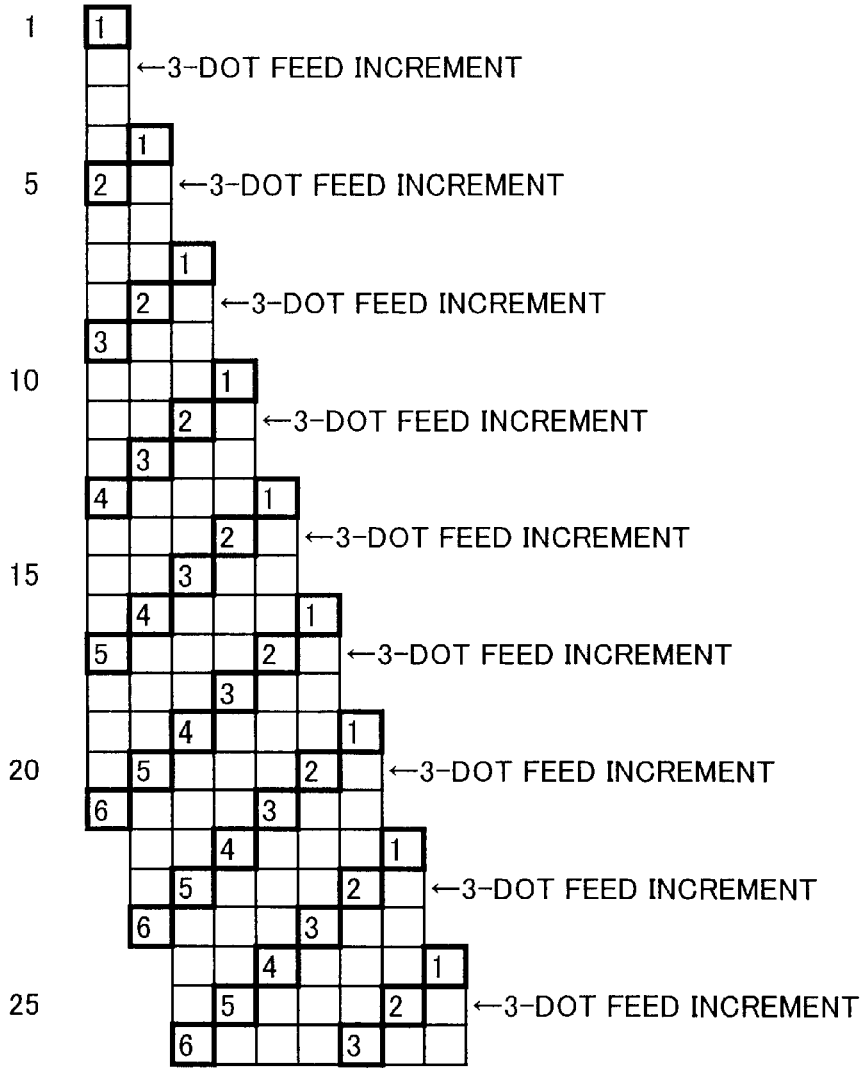
FIG. 11 is a diagram depicting solely the passes for recording the second misalignment verification pattern T30.

FIG. 11 depicts only those passes shown in FIG. 9 during which the second misalignment verification pattern T30 is recorded. The second misalignment verification pattern T30 is such that dots are recorded on the first, third, fifth, seventh, and other main scans, as shown in FIG. 11. All these main scans are forward passes. Consequently, all the raster lines of the second misalignment verification pattern T30 are recorded by the two corresponding nozzles on forward passes (see FIG. 1).

In step S2 (see FIG. 6), the user analyzes test patterns printed as shown in FIG. 8 and selects the gray patch T24 with minimal graininess from the gray patches T21–T25 of the first misalignment verification pattern T20. In the process, a comparison is made with the gray patches T31–T35 of the adjacently printed second misalignment verification pattern T30, and the gray patch with the closest printing results is selected. After the gray patch is selected, the shift adjustment number thereof is entered on the user interface screen (not shown) of the printer driver in the computer 88 (see FIG. 3). The shift adjustment number is stored in the PROM 43 of the printer 20. The shift value associated with the shift adjustment number stored in the PROM 43 is "the adjustment value" referred to in the claims. In addition, the input device (keyboard, mouse, microphone, or the like) of the computer 88 corresponds to "the input unit" referred to in the claims, and the below-described adjustment number storage area 202 of the PROM 43 corresponds to an adjustment value storage unit. The shift adjustment number may also be entered via the control panel 32 (see FIG. 3). In this case, the control panel 32 corresponds to the input unit. When the user indicates that printing is to be performed after a shift adjustment number in agreement with the adjustment value is stored in the RPOM 43, bidirectional printing is performed while the shift is adjusted using the adjustment value.

Figure 12:
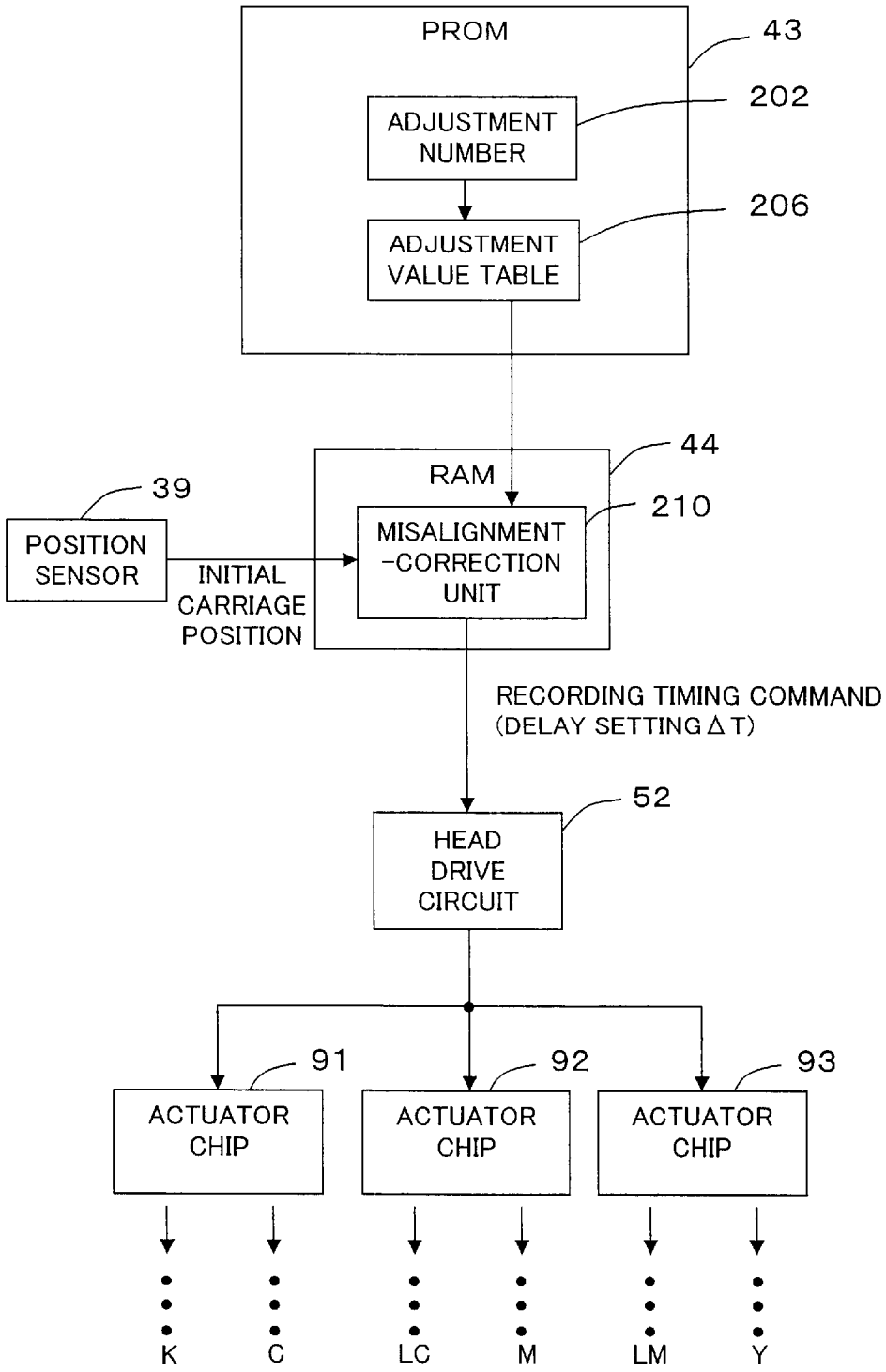
FIG. 12 is a block diagram depicting the principal structure related to misalignment correction during bidirectional printing in the first working example.

FIG. 12 is a block diagram depicting the principal structure related to misalignment correction during bidirectional printing in the first working example. The PROM 43 of the printer 20 comprises the adjustment number storage area 202 and an adjustment value table 206.

Shift adjustment numbers that express preferred adjustment values are stored in the adjustment number storage area 202. The adjustment value table 206 is a table for storing the relation between the shift adjustment numbers and the extent (that is, the adjustment values) to which the dot recording positions of a reverse pass are shifted on the first misalignment verification pattern T20 shown in FIGS. 7 and 8.

Since the adjustment values are set to integral multiples of $1/2880$ inch in the direction of main scanning in the above-described manner, the corresponding recording positions (that is, recording timing) can be adjusted in $1/2880$-inch increments in the direction of main scanning. Although the present arrangement was described with reference to a case in which the dots printed on a reverse pass were shifted in $1/2880$-inch increments, the correction values can be set to an integral multiple of a smaller unit as long as the dots of each color in each of the patches T21–T25 (see FIGS. 7 and 8) are shifted at intervals that correspond to this smaller unit. In other words, the correction values can be set within a narrower range if smaller increments are adopted for the shifting between the positions of dots printed on a reverse pass. The minimum increment value is determined by the control limitations of the printer.

As described above, in the first working example, the following two types of patches are formed in parallel: second color patches (gray patches T31–T35) printed solely during forward passes and accordingly devoid of the dot formation misalignments resulting from bidirectional printing, and first color patches (gray patches T21–T25) printed on the forward and reverse passes of main scanning and made to correspond to adjustment values. First color patches with minimal dot formation misalignments can be easily selected by comparing mutually adjacent color patches and selecting first color patches whose print quality is the closest to that of the second color patches. It is not necessarily easy for the user to visually select a patch with minimal graininess from the lineup of a large number of patches. In particular, it is difficult to compare the graininess levels of patches located at a distance from each other. In the first working example, however, patches T31–T35 (which, theoretically, are free from dot formation misalignments on forward passes, as described above) can be printed nearby, and patches with the closest print results can be selected by comparison therewith. An adjustment value that yields the best print results can thus be easily obtained.

Although the first working example was described with reference to a case in which the second misalignment verification pattern comprised a plurality of color patches (gray patches T31–T35), it is also possible to adopt an arrangement in which the second misalignment verification pattern is composed of an integral color patch rather than a plurality of separate color patches. Specifically, at least part of the second misalignment verification pattern should contain components comparable with the first color patches. Adopting such a structure allows a plurality of first color patches to be contrasted with portions equivalent to the corresponding second misalignment verification pattern, and a first color patch with high-quality print results to be selected.

Another feature of the first working example is that the first color patches T21–T25 and second color patches T31–T35 are printed while aligned in the direction of main scanning. It is therefore possible to reduce the size of the area occupied by the first and second misalignment verification patterns T30 in the direction of sub-scanning on printing paper. A larger number of first color patches (which are equivalent to the corresponding auxiliary adjustment values) can therefore be formed on a sheet of printing paper with the same size.

According to the first working example, gray patches are printed and adjustment values are set using the light cyan, light magenta, and yellow inks commonly used to print grainy halftones. It is therefore possible to make such halftones less grainy and to improve the image quality of print results.

The gray patches T21–T25 are printed by feeding the system substantially the same way as when the system is sub-scanned and fed during actual color printing. It is therefore possible to determine the adjustment values needed to reduce the graininess of print results during actual color printing.

E. Second Working Example

According to the first working example, color patches are formed based on the same image data by bidirectional printing and unidirectional printing, the two are compared, bidirectionally printed patterns whose print results have the highest quality are selected, and adjustment values are set. According to a second working example, color patches are formed based on two separate types of image data about each adjustment value, and adjustment values capable of delivering adequate print results are determined for both images. Separate description are given below for bidirectional printing and unidirectional printing.

(1) Bidirectional Printing

Figure 13:
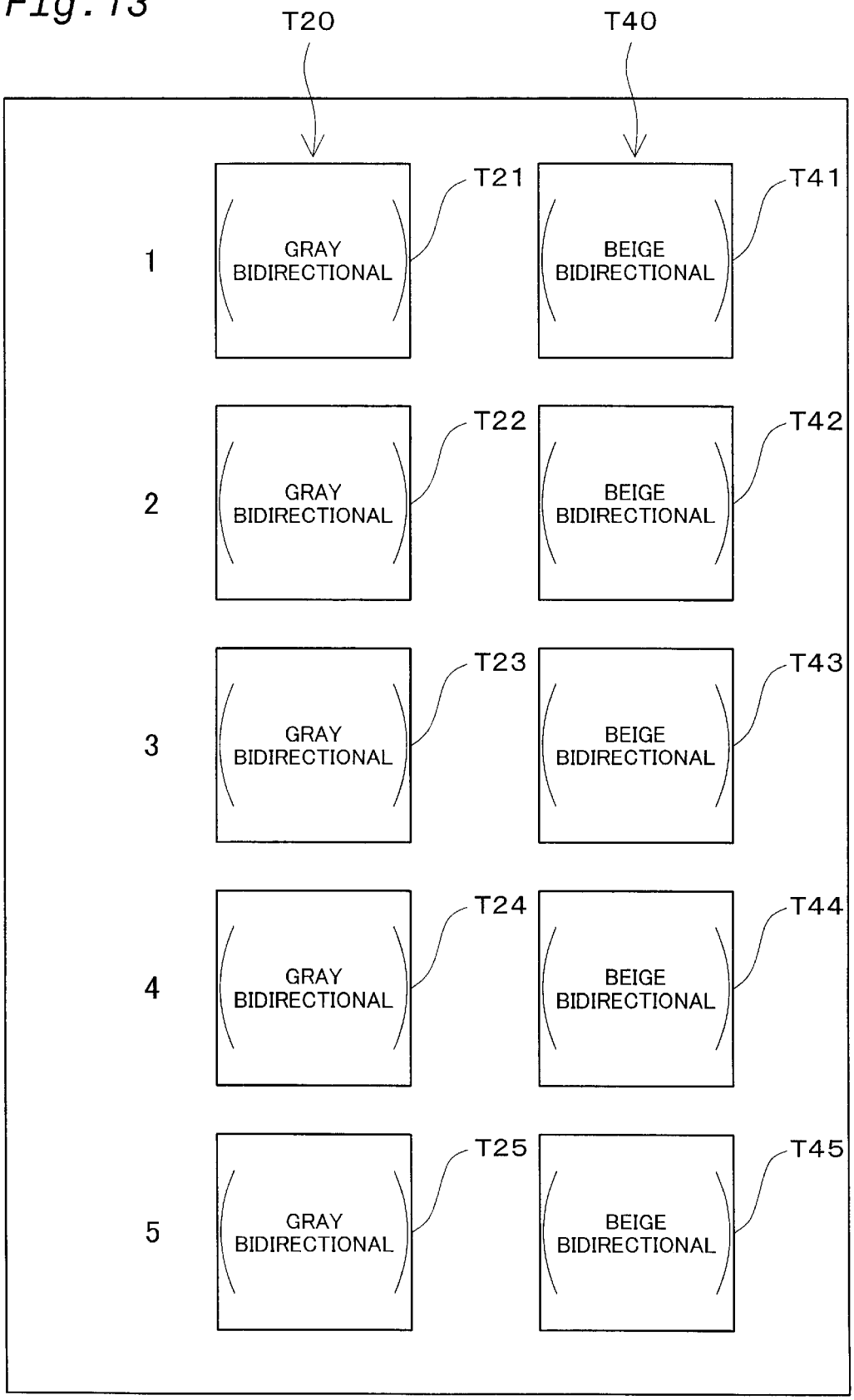
FIG. 13 is a plan view depicting the first misalignment verification pattern T20 and a second misalignment verification pattern T40 on the printing paper P.

FIG. 13 is a plan view depicting a first misalignment verification pattern T20 and a second misalignment verification pattern T40 on printing paper P. The first misalignment verification pattern T20 and second misalignment verification pattern T40 are formed on printing paper P in the same manner as shown in FIG. 8, but the content of the second misalignment verification pattern T40 is different from the one considered in the first working example. Specifically, the patches of the second misalignment verification pattern T40 are formed by a procedure in which ink drops are ejected on the forward and reverse passes of main scanning on the basis of print data D2 for a uniformly dense beige color. These are formed adjacent (at a position aligned in the direction of main scanning) to the corresponding gray patches T21–T25.

These uniformly dense beige patches T41–T45 are formed by shifting the dot formation positions in 1/2880-inch increments in the same manner as in the case of the gray patches T21–T25. The shift in the dot formation positions of the beige patches T41–T45 is equal to the shift in the dot formation positions of the mutually adjacent gray patches T21–T25. The shift of the beige patches T41–T45 corresponds to "the auxiliary adjustment values" referred to in the claims. Specifically, the beige patches T41–T45 are formed using a plurality of mutually different auxiliary adjustment values. The gray patches T21–T25 and beige patches T41–T45 are formed during the same main scan at positions aligned in the direction of main scanning.

Figure 14:
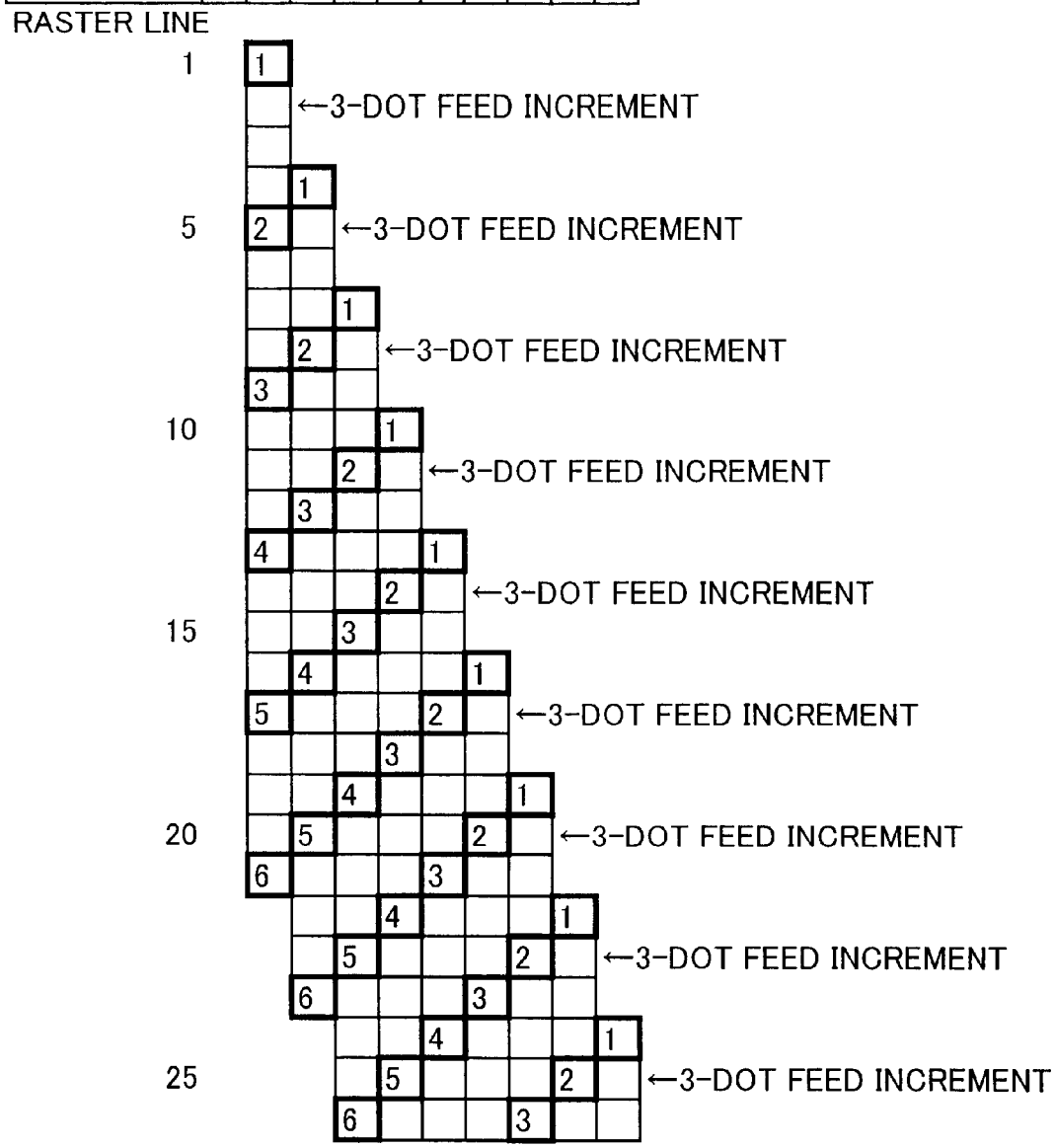
FIG. 14 is a diagram illustrating the manner in which the print head is advanced and dots are recorded during each main scan during the printing of the first misalignment verification pattern T20 and second misalignment verification pattern T30 according to a second working example.

FIG. 14 is a diagram illustrating the manner in which the print head is advanced and dots are recorded during each main scan during the printing of the first misalignment verification pattern T20 and second misalignment verification pattern T40 according to the second working example. In the second working example, the print head is advanced in the manner shown in FIG. 14 because there is no need to perform a main scan in two forward passes for each raster line (in order to print the second misalignment verification pattern T40). In other words, a sub-scan involving a three-dot feed is performed between each pair of main scans on a forward or reverse pass. This feed pattern is identical to the feed pattern performed when the system is sub-scanned and fed during the printing of actual images after the adjustment values have been set.

When the first misalignment verification pattern T20 and second misalignment verification pattern T40 have been printed, the user visually examines the test pattern printed in step S2 (see FIG. 6) and selects a combination of gray and beige patches aligned in the direction from left to right. In the process, the user selects a combination that has minimal graininess for both the gray and beige patches. The adjustment number of the combination is entered into the printer 20. The shift adjustment number is stored in the adjustment number storage area 202 (see FIG. 12) of the printer 20 in the same manner as in the first working example.

According to the second working example, two types of patches (beige patches T41–T45 and gray patches T21–T25) are formed for each auxiliary adjustment value. As a result, it is possible not only to set adjustment values on the basis of the gray patches obtained using all the elements of the three primary colors involved in color printing, but also to set the adjustment values so as to minimize the graininess of the beige images used for depicting actual humans or the like.

The gray patches T21–T25 and beige patches T41–T45 are formed during the same main scan at positions aligned in the direction of main scanning. The shifts can therefore be equalized, there is no need to adopt variable shifting for the timing with which ink drops are ejected during a main scan, and the control procedure can be facilitated.

(2) Unidirectional Printing

In the embodiment described above with reference to FIG. 13, gray patches T21–T25 and beige patches T41–T45 are formed by bidirectional printing, and adjustment values are set for adjusting the dot formation misalignments on the forward and reverse passes of bidirectional printing. The present invention can also be adapted to the adjustment of dot formation misalignments between nozzles during unidirectional printing. For example, actuator chips might be affected by manufacturing errors, and mounting errors might also occur during the mounting of the print head on the carriage. For this reason, each nozzle deposits ink drops at a slightly different position (dot formation position) even when the drops are ejected during the same main scan. Adopting an arrangement such as the one described below can help adjust such dot formation misalignments in these cases as well.

Figure 15:
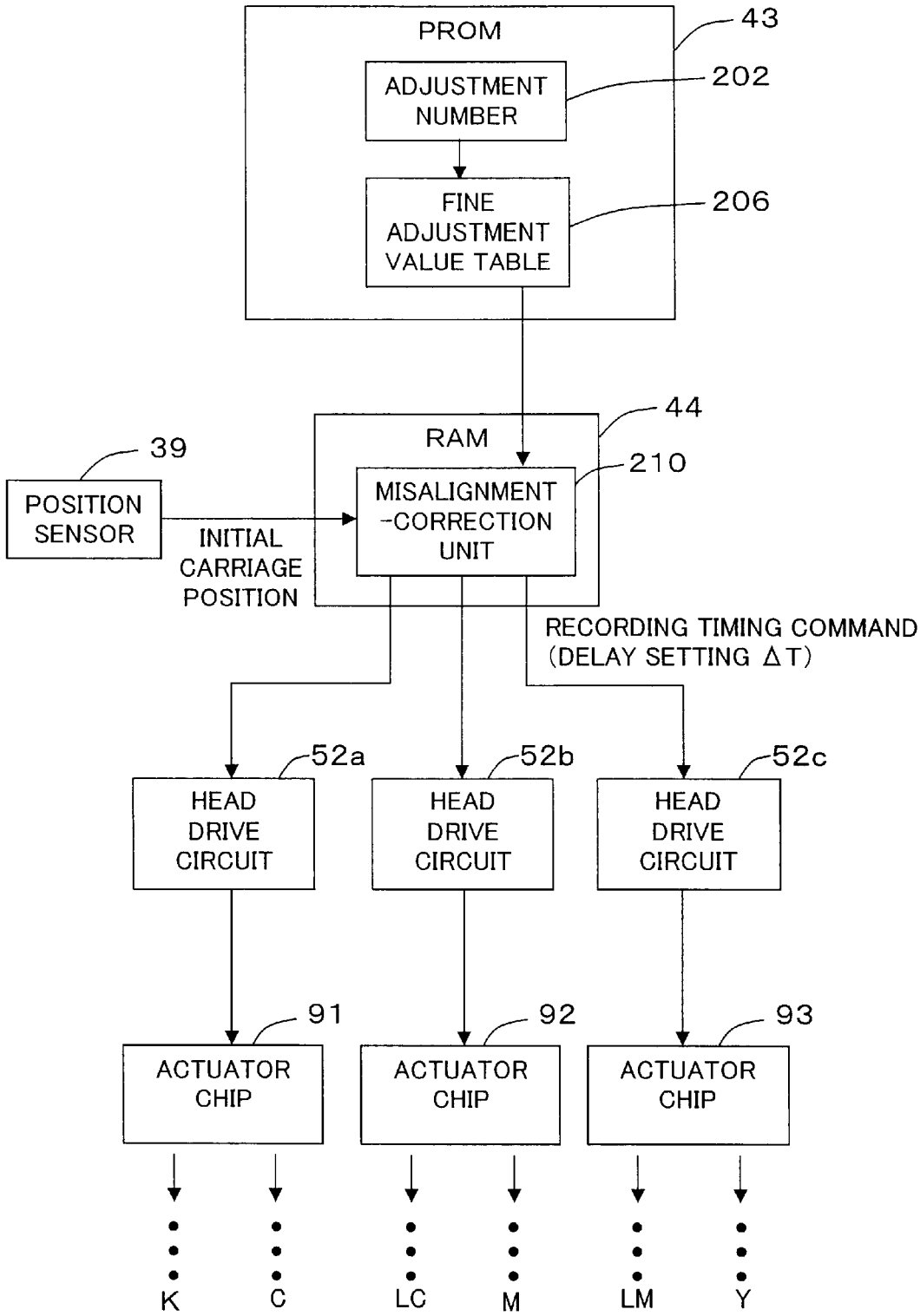
FIG. 15 is a block diagram depicting the principal structure related to misalignment correction during bidirectional printing in the second working example.

FIG. 15 is a block diagram depicting the principal structure related to the misalignment correction of the printing procedure adopted in the second working example. This block diagram has the same structure as the block diagram of FIG. 12 for all of its elements except the head drive circuit and the actuator chip structure. The printing device shown in FIG. 15 is designed for unidirectional printing. The printing device also comprises a head drive circuit 52*c* that is separate from the other actuator chips and is used with the actuator chip 93 for actuating light magenta and yellow nozzle rows. It is therefore possible to shift the ejection timing of the light magenta and yellow nozzle rows in relations to the inks of other colors. The printing device of the second working example also has separate head drive circuits 52*a* and 52*b* for use with the actuator chip 91 for actuating black and cyan nozzle rows, and the actuator chip 92 for actuating light cyan and magenta nozzle rows, respectively. The other features are the same as those of the printing device pertaining to the first working example.

Such a printer is used to form the uniformly dense gray patches T21–T25 and beige patches T41–T45 in an aligned arrangement, as shown in FIG. 13. Each patch is formed by unidirectional printing. The light magenta and yellow dots in the gray patches T21–T25 are formed while slightly shifted relative to the dots of other colors. The shifting of each patch differs by 1/2880 inch. The light magenta and yellow dots in the beige patches T41–T45 are also formed while slightly shifted relative to the dots of other colors. The dots are shifted to the same extent as the dots of the adjacent gray patches located on the left. The user visually examines the print results, selects a combination of gray and beige patches that have minimal graininess, and inputs the corresponding adjustment number into the printer 20.

A misalignment-correcting unit 210 (see FIG. 15) retrieves the adjustment number from the adjustment number storage area 202 and obtains the corresponding adjustment value from the adjustment value table 206 during image printing. The head drive circuit 52*c* is presented with a signal for specifying the head recording timing on the basis of the adjustment value. The head drive circuits for driving other nozzle rows are not provided with any signals for correcting dot formation positions. As a result, light magenta and yellow dot formation positions are adjusted relative to the dots of other colors. Adopting this approach makes it possible to adjust dot formation misalignments among nozzles during unidirectional printing.

Although the description given herein concerned adjusting the timing responsible for ejecting light magenta and yellow ink drops, it is also possible to adjust the timings for ejecting ink drops of other colors. In such cases, gray and beige patches are formed such that each patch is formed by shifting the ejection timing in small increments with respect to the inks whose ejection timing is to be adjusted. Whereas the embodiment shown in FIG. 15 was described with reference to a case in which each actuator chip was used to drive two nozzle rows, adopting an arrangement in which a nozzle row designed to eject a particular color ink is provided with a separate actuator chip makes it possible to eject ink drops with a finer timing resolution (that is, to obtain better dot formation positions), and is thus preferred.

According to the first working example, first color patches are formed by bidirectional printing, and second color patches are formed by unidirectional printing. The second working example involves forming patches of different colors (gray and beige). It is also possible to adopt any other arrangement as long as the second color patches differ from the first color patches either in terms of color or in terms of printing method. An example of an arrangement in which different printing methods are used is one in which different feed patterns are used for sub-scanning during the formation of first and second color patches. Adopting this arrangement makes it possible to compare the first and second color patches and to set an adjustment value that improves the quality (reduces the graininess) of print results for a plurality of types of feed patterns employed during sub-scanning. It is also possible to form the first color patches with relatively large dots, and the second color patches with relatively small dots. Adopting this arrangement makes it possible to determine an adjustment value capable of yielding adequate print results with images represented by the dots of corresponding sizes. A single adjustment value can also be used to print three types of color patches (color patches formed with comparatively large dots, color patches formed with comparatively small dots, and color patches formed with both comparatively large and comparatively small dots), and to determine the desired adjustment values with consideration for the print quality of each type of patch. Thus, the phrase "different printing methods" can refer to any arrangement in which some aspect of printing is varied while the underlying image data remain the same.

F. Modifications

The present invention is not limited by the above-described working examples or embodiments and can be implemented in a variety of ways as long as the essence thereof is not compromised. For example, the following modifications are possible.

F1. Modification 1

Figure 16:
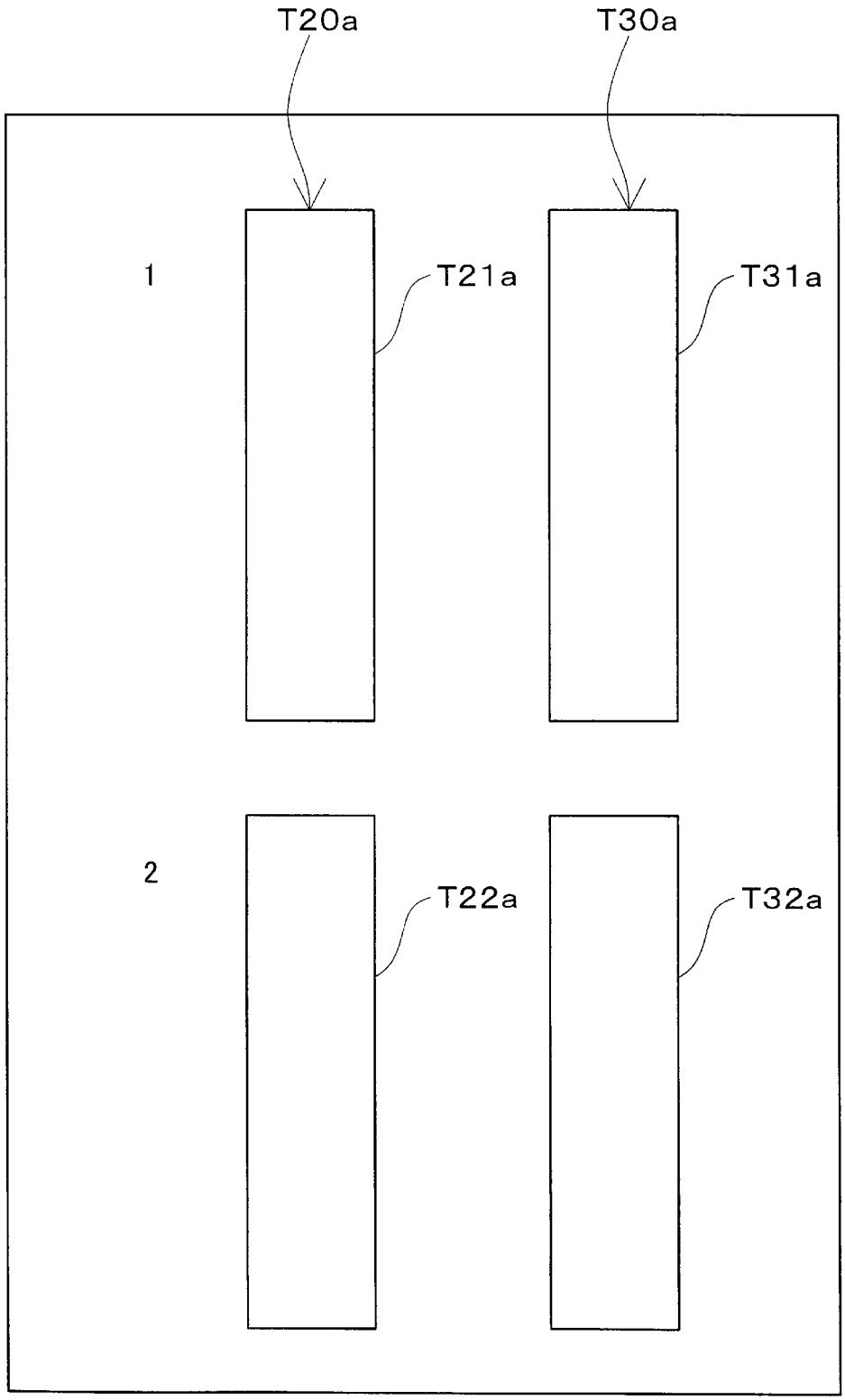
FIG. 16 is a plan view depicting a first misalignment verification pattern T20*a* and a second misalignment verification pattern T30*a* on the printing paper P according to a modification.

FIG. 16 is a plan view depicting a first misalignment verification pattern T20*a* and a second misalignment verification pattern T30*a* on printing paper P according to a modification. An adjustment value can be set with consideration for the quality degradation of print results due to errors affecting sub-scanning/feeding if the patches are extended in the direction of sub-scanning, as shown in FIG. 16. The patches T21*a*–T25*a* and T31*a*–T35*a* (T23*a*–T25*a* or T33*a*–T35*a* are not shown) should preferably be formed across at least one fourth of the printable area on the printing paper in the direction perpendicular to the direction of main scanning. Forming the patches within this range allows these patches to fully reflect the errors affecting sub-scanning feed when images are printed in the printable area. In this case, a smaller number of patches can be formed on a single sheet of printing paper, but forming the patches on a plurality of sheets of printing paper makes it possible to form such patches with substantially the same number of auxiliary adjustment values as in the first or second working example. "Printable area" is an area in which the printer can form images on a print medium. The printable area has limitations in terms of mechanical structure, control method, or other printer attributes. For example, the mechanical structure, control method, or other printer attributes sometimes prevent images from being printed on a sheet of printing paper with a 15-mm upper margin, a 10-mm lower margin, and 5-mm side margins. In such cases, the printable area is the inside area of a sheet of printing paper with a 15-mm upper margin, a 10-mm lower margin, and 5-mm side margins. Such printable areas may, for example, be described in printer manuals. Information about printable area settings is sometimes displays in the driver settings window on the computer display. The printable area occupies the entire print medium if images can be formed over the entire print medium.

F2. Modification 2

Figure 17:
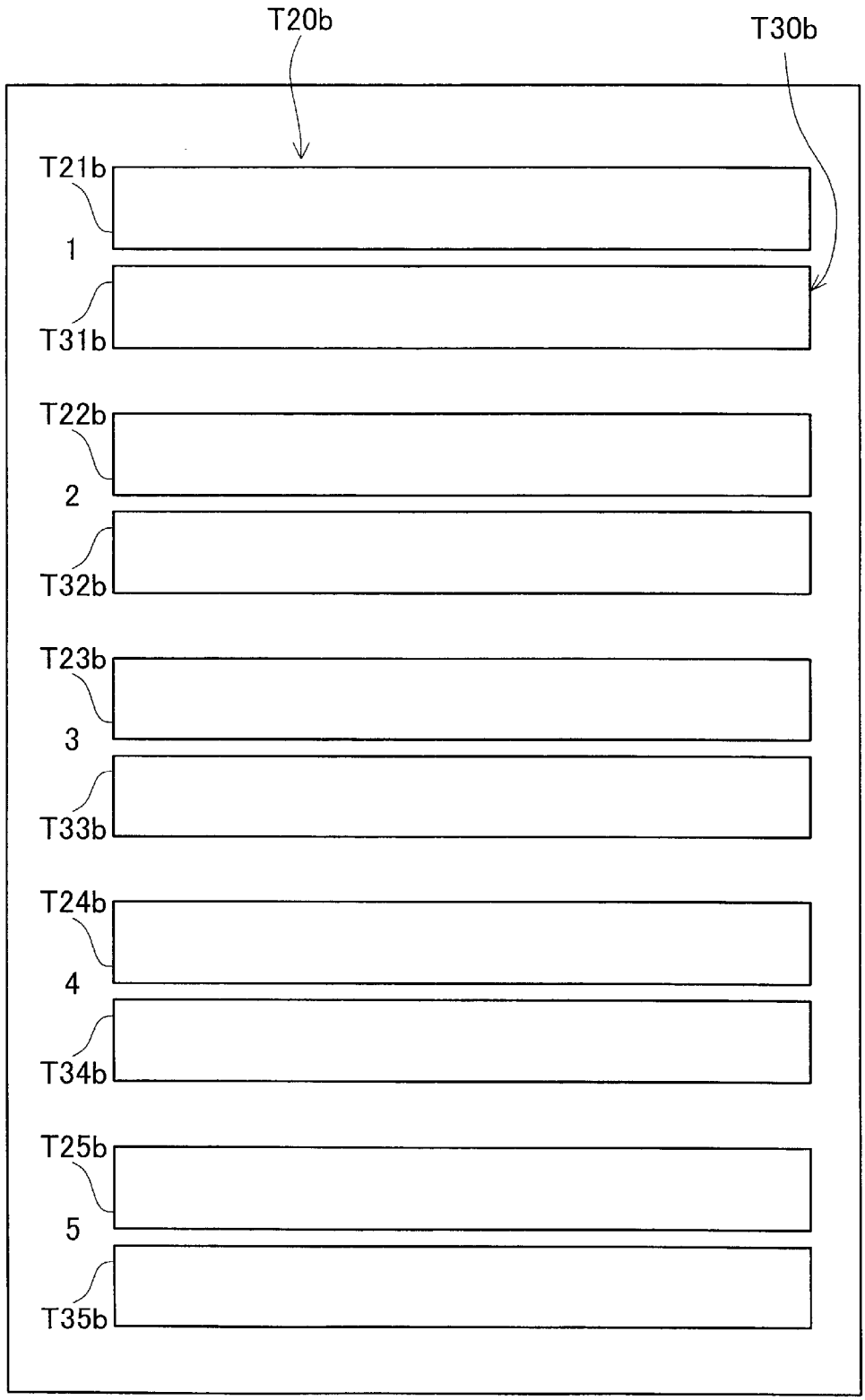
FIG. 17 is a plan view depicting a first misalignment verification pattern T20 and a second misalignment verification pattern T30*b* on the printing paper P according to a modification.

FIG. 17 is a plan view depicting a first misalignment verification pattern T20*b* and a second misalignment verification pattern T30*b* on the printing paper P according to another modification. An adjustment value can be set with consideration for the quality degradation of print results due to errors affecting main scanning feed if the patches are extended in the direction of main scanning, as shown in FIG. 17. The patches T21*b*–T25*b* and T31*b*–T35*b* should preferably be formed across at least half of the printable area on the printing paper in the direction of main scanning. Forming the patches within this range allows these patches to fully reflect the errors affecting main scanning feed when images are printed in the printable area. It is also possible to vary the manner in which the system is sub-scanned and fed during the printing of patches when the patches T21*b*–T25*b* of the first misalignment verification pattern T20*b* are printed on the forward and reverse passes of a main scan, and the patches T31*b*–T35*b* of the second misalignment verification pattern T30*b* are printed solely on the forward pass of a main scan. The feed pattern can be readily switched during printing by making the interval between the two types of patches greater than the length of the nozzle rows on the print head.

F3. Combinations of Modifications and Types of Misalignments to Be Adjusted With Adjustment Values FIG. 18 is a table that lists combinations of modifications and types of misalignments to be adjusted with adjustment values. In the first working example and in (1) of the second working example, adjustment values were determined for adjusting dot formation misalignments on the forward and reverse passes of a main scan during bidirectional printing. In (2) of the second working example, adjustment values were determined for adjusting dot formation misalignments between the nozzles. The above modifications may also be used to set up adjustment values for the dot formation misalignments of bidirectional printing in the manner adopted for the first working example, or to set up adjustment values for the dot formation misalignments between the nozzles in the manner adopted for (2) of the second working example, as shown in FIG. 18.

G. Other Modifications (1) The second working example was described with reference to a case in which a first color patch and a second color patch were printed for each adjustment value on the basis of two types of image data. It is also possible, however, to print three or more color patches for each adjustment value on the basis of three or more types of image data. In other words, a plurality of first and second color patches can be formed for each adjustment value. Adopting this arrangement makes it possible to remove the dot formation misalignments between the nozzles by taking into account the degree to which each adjustment value can yield high-quality for each image, respectively.

(2) There is no need to form the first and second color patches on the same sheet of printing paper. Even when the first and second color patches are formed on different sheets of printing paper, adjustment values capable of yielding high-quality print results can still be selected on the basis of the color patches thus printed. It is also possible to adopt an arrangement in which a first color patch is formed on a sheet of printing paper, the printing paper is reintroduced into the printing device, and a second color patch is formed on the remaining portion of the printing paper having the first color patch.

(3) Although the above working examples were described with reference to cases in which gray patches were printed using light cyan, light magenta, and yellow inks, the inks that can be used are not limited to these combinations alone. In the specific case in which the chromatic inks used for color printing are the three colors magenta, cyan, and yellow, the gray patches can be printed using these three color inks. When the chromatic inks used for color printing are the five colors dark magenta, dark cyan, yellow, light magenta, and light cyan, the patches can be printed using combinations that contain colors other than the three colors yellow, light magenta, and light cyan. In other words, any color combination may be used for the first and second color patches as long as these patches are formed using two or more monochromatic nozzle groups.

(4) Although the above working examples were described with reference to cases in which the nozzle groups for ejecting monochromatic inks consisted of nozzles arranged in rows, the nozzle arrangement is not limited to this option alone. In other words, any nozzle assembly for ejecting monochromatic inks may be used.

(5) Although the first working example and (1) in the second working example were described with reference to cases in which misalignments were corrected by adjusting recording positions (or recording timing) on a reverse pass, it is also possible to correct such misalignments by adjusting recording positions on a forward pass. Another option is to correct misalignments by adjusting recording positions on both forward and reverse passes. In other words, any arrangement can usually be adopted as long as misalignments can be corrected by adjusting recording positions on forward and/or reverse passes.

(6) Although the above working examples were described with reference to an ink-jet printer, the present invention is not limited to ink-jet printers and can usually be adapted to a variety of printing devices in which images are printed using a print head. In addition, the present invention is not limited to methods or devices for ejecting ink drops and can be adapted to methods or devices for recording dots by other means.

(7) In the above working examples, software can be used to perform some hardware functions, or, conversely, hardware can be used to perform some software functions. For example, software can be used to perform some of the functions assigned to the head drive circuits 52 and 52*a*–52*c* shown in FIGS. 12 and 15.

INDUSTRIAL APPLICABILITY

The present invention can be adapted to ink-jet printers and various other image output devices for outputting images by employing dots.

What is claimed is:

1. A method for determining an adjustment value for reducing dot formation misalignments in a direction of main scanning during a process in which a printing device provided with a plurality of monochromatic nozzle groups for ejecting ink drops of mutually different colors is used to print images by depositing ink drops on a print medium and forming dots while main scanning is performed to move the plurality of monochromatic nozzle groups and/or the print medium, the adjustment value determination method comprising the steps of:

(a) forming a plurality of first color patches on a print medium with dots composed of two or more types of inkfor a plurality of auxiliary adjustment values, respectively, the plurality of first color patches being designed to reproduce mutually identical colors;

(b) forming a second color patch on a print medium using dots composed of two or more types of ink in a different color and/or different printing scheme from that of the plurality of first color patches; and (c) selecting the adjustment value from the plurality of auxiliary adjustment values on the basis of the plurality of first color patches and the second color patch.

2. An adjustment value determination method as defined in claim 1, wherein the step (b) comprises the step of:

(b1) forming the second color patch on the print medium by a printing scheme different from that adopted for the plurality of first color patches, the second color patch reproducing the same color as that adopted for the plurality of first color patches.

3. An adjustment value determination method as defined in claim 2, wherein the step (a) comprises the step of:

(a1) forming the plurality of first color patches by bidirectional printing; and the step (b1) comprises the step of:

(b11) forming the second color patch by unidirectional printing.

4. An adjustment value determination method as defined in claim 3, wherein gray is selected as a color of the plurality of first color patches and the second color patch.

5. An adjustment value determination method as defined in claim 3, wherein the step (b11) comprises the step of:

(b111) forming a plurality of second color patches for reproducing mutually identical colors at positions aligned in the direction of main scanning in relation to the plurality of first color patches.

6. An adjustment value determination method as defined in claim 3, wherein the step (a) comprises the step of:

(a2) forming each of the first color patches over at least one fourth of a printable area on the print medium in a direction perpendicular to the direction of main scanning; and the step (b) comprises the step of:

(b2)forming the second color patch over at least one fourth of the printable area on the print medium in the direction perpendicular to the direction of main scanning.

7. An adjustment value determination method as defined in claim 3, wherein the step (a) comprises the step of:

(a3) forming the first color patches over at least half of a printable area on the print medium in the direction of main scanning; and the step (b) comprises the step of:

(b3) forming the second color patch over at least half of the printable area on the print medium in the direction of main scanning.

8. An adjustment value determination method as defined in claim 1, wherein the step (b) comprises the step of:

(b1) forming a plurality of second color patches on the print medium using the plurality of auxiliary adjustment values by the same printing scheme as the one used to print the plurality of first color patches, the plurality of second color patches being designed to reproduce mutually identical colors and being colored differently than the plurality of first color patches.

9. An adjustment value determination method as defined in claim 8, wherein the step (b1) comprises the steps of:

(b11) forming the plurality of second color patches at positions aligned in the direction of main scanning in relation to the plurality of first color patches.

10. A printing device for printing images by ejecting ink drops from nozzles and depositing the ink drops on a print medium to form dots, comprising:

a plurality of monochromatic nozzle groups for ejecting ink drops of mutually different single colors, respectively;

a main scanning unit configured to perform main scanning by moving the plurality of monochromatic nozzle groups and/or the print medium;

an input unit configured to receive data input from outside; and a control unit configured to control printing, the control unit comprises:

a first patch-forming unit configured to form a plurality of first color patches on a print medium with dots composed of two or more types of ink using a plurality of auxiliary adjustment values, respectively, the plurality of first color patches being designed to reproduce mutually identical colors;

a second patch-forming unit configured to form a second color patch on a print medium using dots composed of two or more types of ink in a different color and/or different printing scheme from that of the plurality of first color patches; and an adjustment value storage unit configured to store an adjustment value selected from the plurality of auxiliary adjustment values and entered into the input unit on the basis of the plurality of first color patches and the second color patch.

11. A printing device as defined in claim 10, wherein the second patch-forming unit forms the second color patch on the print medium by a printing scheme different from that adopted for the plurality of first color patches, the second color patch reproducing the same color as that adopted for the plurality of first color patches.

12. A printing device as defined in claim 11, wherein the first patch-forming unit forms the plurality of first color patches by bidirectional printing; and the second patch-forming unit forms the second color patch by unidirectional printing.

13. A printing device as defined in claim 12, wherein a color of the plurality of first color patches and the second color patch is gray.

14. A printing device as defined in claim 12, wherein the second patch-forming unit forms a plurality of second color patches for reproducing mutually identical colors at positions aligned in the direction of main scanning in relation to the plurality of first color patches.

15. A printing device as defined in claim 12, wherein the first patch-forming unit forms each of the first color patches over at least one fourth of a printable area on the print medium in a direction perpendicular to the direction of main scanning; and the second patch-forming unit forms the second color patch over at least one fourth of the printable area on the print medium in the direction perpendicular to the direction of main scanning.

16. A printing device as defined in claim 12, wherein the first patch-forming unit forms the first color patches over at least half of a printable area on the print medium in the direction of main scanning; and the second patch-forming unit forms the second color patch over at least half of the printable area on the print medium in the direction of main scanning.

17. A printing device as defined in claim 10, wherein the second patch-forming unit forms a plurality of second color patches on the print medium using the plurality of auxiliary adjustment values by the same printing scheme as the one used to print the plurality of first color patches, the plurality of second color patches being designed to reproduce mutually identical colors and being colored differently than the plurality of first color patches.

18. A printing device as defined in claim 17, wherein the second patch-forming unit forms the plurality of second color patches at positions aligned in the direction of main scanning in relation to the plurality of first color patches.

19. A computer program product designed to allow misalignment verification patterns for determining an adjustment value that can be used to reduce dot formation misalignments during printing to be formed by a computer comprising a print unit comprising a plurality of monochromatic nozzle groups for ejecting ink drops of mutually different colors, wherein the computer program product is such that the adjustment value is designed to reduce dot formation misalignments in a direction of main scanning during a process in which images are printed by depositing ink drops on a print medium and forming dots while main scanning is performed to move the plurality of monochromatic nozzle groups and/or the print medium;

a computer-readable medium; and computer programs stored on the computer-readable medium; and the computer programs comprises:

a first program for causing the computer to form a plurality of first color patches on a print medium with dots composed of two or more types of ink for a plurality of auxiliary adjustment values, respectively the plurality of first color patches being designed to reproduce mutually identical colors;

a second program for causing the computer to form a second color patch on a print medium using dots composed of two or more types of ink in a different color and/or different method from that of the plurality of first color patches; and a third program for causing the computer to store the adjustment value selected from the plurality of auxiliary adjustment values and entered into an input on the basis of the plurality of first color patches and the second color patch.

20. A computer program product as defined in claim 19, wherein the second program comprises a fourth program for causing the computer to form the second color patch on the print medium by a printing scheme different from that adopted for the plurality of first color patches, the second color patch reproducing the same color as that adopted for the plurality of first color patches.

21. A computer program product as defined in claim 20, wherein the first program comprises a fifth program for causing the computer to form the plurality of first color patches by bidirectional printing; and the fourth program comprises a sixth program for causing the computer to form the second color patch by unidirectional printing.

22. A computer program product as defined in claim 21, wherein a color of the plurality of first color patches and the second color patch is gray.

23. A computer program product as defined in claim 21, wherein the sixth program comprises a seventh program for causing the computer to form a plurality of second color patches for reproducing mutually identical colors at positions aligned in the direction of main scanning in relation to the plurality of first color patches.

24. A computer program product as defined in claim 21, wherein the first program comprises a seventh program for causing the computer to form each of the first color patches over at least one fourth of a printable area on the print medium in a direction perpendicular to the direction of main scanning; and the second program comprises a eighth program for causing the computer to form the second color patch over at least one fourth of the printable area on the print medium in the direction perpendicular to the direction of main scanning.

25. A computer program product as defined in claim 21, wherein the first program comprises a seventh program for causing the computer to form the first color patches over at least half of a printable area on the print medium in the direction of main scanning; and the second program comprises a eighth program for causing the computer to form the second color patch over at least half of the printable area on the print medium in the direction of main scanning.

26. A computer program product as defined in claim 19, wherein the second program comprises a fourth program for causing the computer to form a plurality of second color patches on the print medium using the plurality of auxiliary adjustment values by the same printing scheme as the one used to print the plurality of first color patches, the plurality of second color patches being designed to reproduce mutually identical colors and being colored differently than the plurality of first color patches.

27. A computer program product as defined in claim 26, wherein the fourth program comprises a fifth program for causing the computer to form the plurality of second color patches at positions aligned in the direction of main scanning in relation to the plurality of first color patches.

* * * * *